US007662532B2

(12) United States Patent
Tomita

(10) Patent No.: US 7,662,532 B2
(45) Date of Patent: Feb. 16, 2010

(54) IMAGE FORMING METHOD AND IMAGE FORMING APPARATUS

(75) Inventor: Masami Tomita, Numazu (JP)

(73) Assignee: Ricoh Company Limited, Tokyo (JP)

( * ) Notice: Subject to any disclaimer, the term of this patent is extended or adjusted under 35 U.S.C. 154(b) by 294 days.

(21) Appl. No.: 11/682,955

(22) Filed: Mar. 7, 2007

(65) Prior Publication Data

US 2007/0218396 A1 Sep. 20, 2007

(30) Foreign Application Priority Data

Mar. 17, 2006 (JP) ..... 2006-075659

(51) Int. Cl.
*G03G 15/20* (2006.01)

(52) U.S. Cl. ..... 430/123.52; 430/124.1

(58) Field of Classification Search ..... 430/123.52, 430/124.1

See application file for complete search history.

(56) References Cited

U.S. PATENT DOCUMENTS

| | | | | |
|---|---|---|---|---|
| 6,363,229 | B1 | 3/2002 | Shiraishi et al. | |
| 6,740,460 | B2 | 5/2004 | Tomita et al. | |
| 6,756,175 | B2 | 6/2004 | Yamada et al. | |
| 6,824,945 | B2 | 11/2004 | Emoto et al. | |
| 7,056,636 | B2 | 6/2006 | Tomita et al. | |
| 7,437,111 | B2 * | 10/2008 | Yamada et al. | 399/327 |
| 2001/0044059 | A1 | 11/2001 | Miyamoto et al. | |
| 2002/0098436 | A1 | 7/2002 | Miyamoto et al. | |
| 2003/0027066 | A1 | 2/2003 | Yamashita et al. | |
| 2003/0055159 | A1 | 3/2003 | Yamashita et al. | |
| 2003/0096185 | A1 | 5/2003 | Yamashita et al. | |
| 2003/0113648 | A1 * | 6/2003 | Tomita et al. | 430/109.4 |
| 2004/0076901 | A1 | 4/2004 | Miyamoto et al. | |
| 2004/0137356 | A1 * | 7/2004 | Tomita et al. | 430/124 |
| 2006/0093946 | A1 | 5/2006 | Miyamoto et al. | |

FOREIGN PATENT DOCUMENTS

| | | |
|---|---|---|
| JP | 2002-49258 | 2/2002 |
| JP | 2003-167384 | 6/2003 |
| JP | 2003-280412 | 10/2003 |

OTHER PUBLICATIONS

U.S. Appl. No. 11/943,713, filed Nov. 21, 2007, Ishikawa, et al.
U.S. Appl. No. 09/384,797, filed Aug. 27, 1999, Satoru Miyamoto, et al.

* cited by examiner

*Primary Examiner*—John L Goodrow
(74) *Attorney, Agent, or Firm*—Oblon, Spivak, McClelland, Maier & Neustadt, L.L.P.

(57) ABSTRACT

An image forming method including forming an image of a toner on a receiving material; and fixing the toner image on the receiving upon application of heat and pressure thereto, wherein the weight average particle diameter (D4) of the toner is from 2.0 to 4.5 μm, the pressure (P) is not greater than 15 N/cm$^2$, P×D4 is not less than 30 N/cm$^2$·μm, the melt viscosity (Gw110) of the toner at 110° C. is from 3,000 to 40,000 Pa·s, the melt viscosity (Gw140) of the toner at 140° C. is from 100 to 1,000 Pa·s, and the ratio Gw110/Gw140 is not less than 30.

8 Claims, 9 Drawing Sheets

IMAGE FORMING METHOD AND IMAGE FORMING APPARATUS

BACKGROUND OF THE INVENTION

1. Field of the Invention

The present invention relates to an image forming method and an image forming apparatus, and more particularly to an image forming method and an image forming apparatus, which form a visual image using a toner.

2. Discussion of the Background

Image forming methods in which an electrostatic image formed on an image bearing member is visualized using a toner are broadly used for various fields. The image forming methods typically include the following processes:

(1) charging an image bearing member (charging process)
(2) irradiating the charged image bearing member with light to form an electrostatic latent image (light irradiating process);
(3) developing the electrostatic latent image with a developer including a toner to form a toner image on the image bearing member (developing process);
(4) transferring the toner image onto a receiving material optionally via an intermediate transfer medium (transferring process); and
(5) fixing the toner image on the receiving material, resulting in formation of an image (fixing process).

In the fixing process, the toner image on the receiving material is heated and melted by a fixing member such as fixing rollers and fixing belts so as to be fixed on the receiving material.

Recently, in the electrophotographic image forming field, a technology change of from black and white image formation to full color image formation occurs at high speed. Therefore, the full color image formation market is remarkably increasing. In the electrophotographic full color image formation field, a need exists for forming high quality full color images.

On the other hand, a need exists for shortening the warm-up time of electrophotographic image forming apparatuses. Therefore, fixing techniques in that a belt or a film, which has a lower heat capacity than a fixing roller, is used as a fixing member, have been proposed by, for example, published unexamined Japanese patent applications Nos. (hereinafter referred to as JP-As) 2002-049258 and 2003-280412. These fixing techniques are practically used.

The fixing members such as belts and films have an advantage in that a wide fixing nip width can be obtained as well as the above-mentioned advantage of shortening the warm-up time, but have a drawback in that a sufficient pressure cannot be applied to toner images. Particularly, when a toner image constituted of a toner having a small particle diameter, which is used to form high quality images, is fixed by such a belt or film fixing member, sufficient energy cannot be applied to the toner. In this case, the toner is insufficiently melted, and therefore the fixed toner image has poor fixing property and low glossiness, which is a fatal flaw for full color images. In this regard, increase in the fixing pressure to improve the fixing property and glossiness causes a problem in that the belt or film used as the fixing member is damaged (i.e., formation of scratches, etc.) after long repeated use, resulting in deterioration of fixing property of toner images.

In order that a fixed toner image has a high glossiness, the toner particles of the toner image have to be fully melted when contacted with a fixing member. Therefore, it is necessary to heat the fixing member to a considerably high temperature. In this case, a hot offset problem in that part of the fixed toner image or the entire toner image is adhered to the fixing member tends to occur. In order to improve the fixing property on the toner side, techniques in that a crystalline polyester resin is included in a toner have been proposed by, for example, JP-A 2003-167384.

In order to prevent the hot offset problem and deterioration of the surface of the fixing member, techniques in that a fixing member whose surface is formed of a material having good releasability from toner (such as silicone rubbers and fluorine-containing resins) is used while applying a liquid having good releasability (such as silicone oils and fluorine containing oils) to the surface of the fixing member have been used.

Although these techniques are effective for preventing the hot offset problem, an applicator for applying an offset preventing liquid to the fixing member has to be provided. Therefore, the fixing device is complicated. In addition, the fixing member easily causes a problem in that one or more layers formed on the fixing member are released from the other layers or the substrate, resulting in shortening of the life of the fixing device.

Therefore, recently oil-less fixing devices without using such an applicator have been proposed.

The toner used for such oil-less fixing devices has to have good releasability from the surface of the fixing member used. For example, the following techniques have been proposed:

(1) a resin having high polymerization degree is used for the toner to increase viscoelasticity of the toner and to impart good releasability to the toner; and
(2) instead of applying a release agent to the fixing member, a toner which includes therein a release agent such as low molecular weight polypropylenes so that the release agent is applied to the surface of the fixing member when the toner is heated is used.

When color images are formed, the fixing member is typically heated to a considerably high temperature. Therefore, it is necessary for the toner mentioned above in paragraph (2) to include a large amount of release agent. In this case, the toner is melted by being heated and pressed by a fixing member, and therefore the release agent in the toner exudes therefrom. The thus exuding release agent is present between the toner and the fixing member, thereby preventing the toner image from adhering to the fixing member, resulting in prevention of occurrence of the offset problem. However, in the above-mentioned fixing devices which use a belt or a film as a fixing member while applying a low pressure to a toner image, the release agent in the toner insufficiently exudes from the toner, and thereby good offset preventing effect cannot be produced.

In addition, when the content of a release agent in a toner is increased, the fixed color toner image has a high haze factor. In this case, the image qualities (particularly, color reproducibility) of the color image deteriorate.

As mentioned above, it is difficult to stably produce color images having good fixing property and high glossiness when a fixing device, which uses a belt or a film as a fixing member while applying a low pressure to the toner image to be fixed, is used.

Because of these reasons, a need exists for an image forming method and apparatus which can stably produce color images having good fixing property and high glossiness by using a fixing device, which uses a belt or a film as a fixing member while applying a low pressure to the toner image to be fixed.

SUMMARY OF THE INVENTION

As an aspect of the present invention, an image forming method is provided which includes the steps of forming an image of a toner on a receiving material, and fixing the toner image on the receiving material upon application of heat and pressure thereto. In this image forming method, the following relationships (1) to (6) are satisfied:

$$2.0\ \mu m \leqq D4 \leqq 4.5\ \mu m \quad (1),$$

$$P \leqq 15\ N/cm^2 \quad (2),$$

$$P \times D4 \geqq 30\ N/cm^2 \cdot \mu m \quad (3),$$

$$3{,}000\ Pa \cdot s \leqq Gw110 \leqq 40{,}000\ Pa \cdot s \quad (4),$$

$$100\ Pa \cdot s \leqq Gw140 \leqq 1{,}000\ Pa \cdot s \quad (5), \text{ and}$$

$$Gw110/Gw140 \geqq 30 \quad (6),$$

wherein D4 represents the weight average particle diameter of the toner; Gw110 and Gw140 represent the melt viscosity of the toner at 110 and 140° C., respectively; and P represents the fixing pressure.

The toner preferably satisfies the following relationship:

$$D4/Dn \leqq 1.25,$$

wherein Dn represents the number average particle diameter of the toner.

It is preferable that the toner has a glass transition temperature of from 40 to 55° C., and includes a crystalline polyester resin as a binder resin, which preferably has a melting point of from 80 to 130° C.

The toner preferably includes a release agent, which preferably has a melting point of from 60 to 80° C. The weight ratio (R/B) of the release agent (R) to the binder resin (B) in the toner is preferably from 0.03 to 0.10.

As another aspect of the present invention, an image forming apparatus is provided which includes at least an image bearing member configured to bear a toner image thereon, a transfer device configured to transfer the toner image onto a receiving material, and a fixing device configured to fix the toner image on the receiving material upon application of heat and pressure thereto, wherein the above-mentioned relationships (1) to (6) are satisfied.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

At first, the fixing device for fixing a toner image for use in the image forming apparatus of the present invention will be explained.

1. Example of Heat Roller Fixing Device

Figure 1:
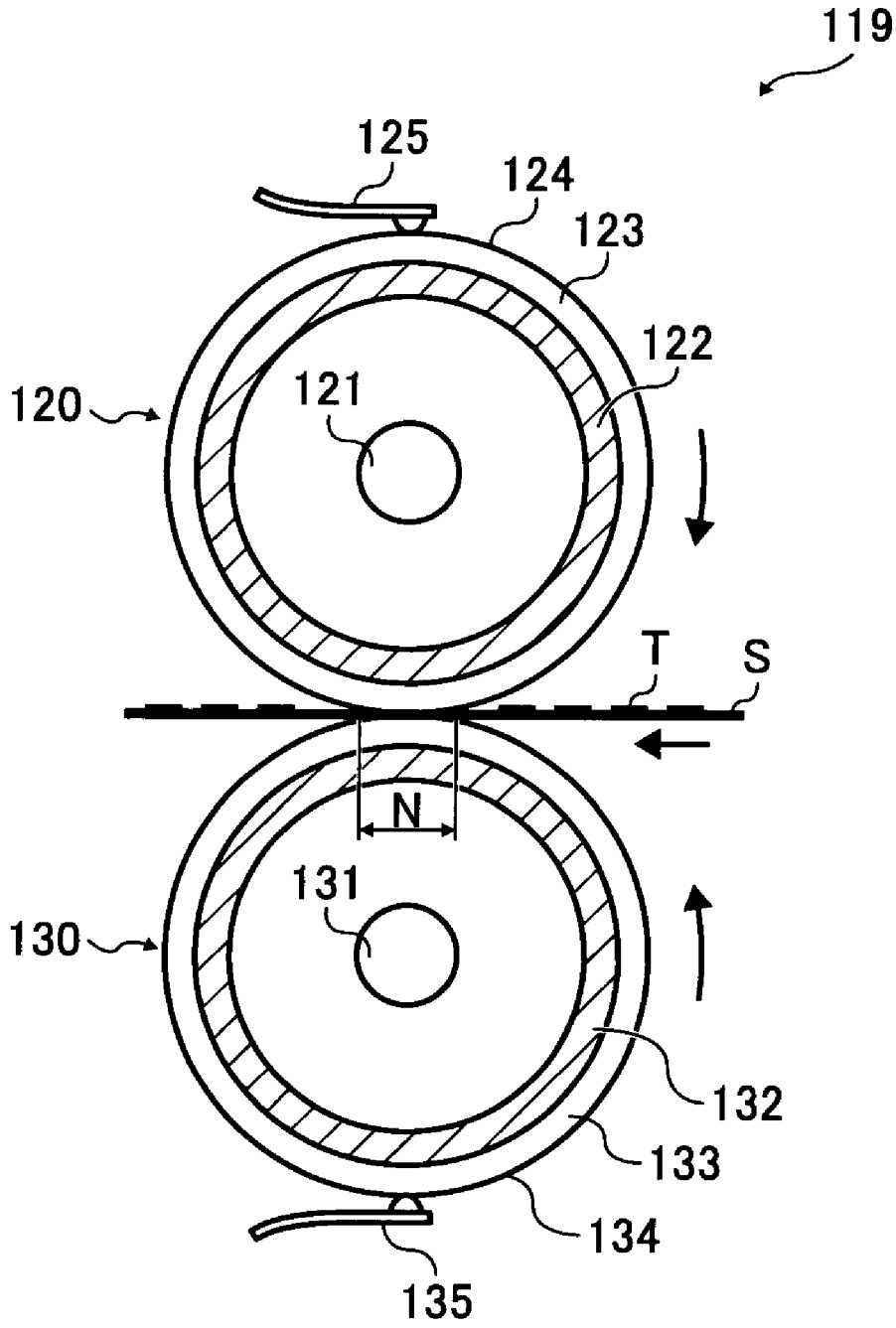
FIGS. 1 and 2 are schematic views illustrating the cross sections of background fixing devices, which can also be used for the image forming apparatus of the present invention.

An example of heat roller fixing devices for use in color image forming apparatuses is illustrated in FIG. 1. Referring to FIG. 1, a fixing device 119 includes a fixing roller 120 and a pressure roller 130, both of which rotate while pressing each other. A receiving sheet S bearing an unfixed toner image T thereon is passed through a nip N formed by the fixing roller 120 and the pressure roller 130, which apply heat and pressure to the receiving sheet, and thereby the toner image T is fixed to the receiving sheet S.

The fixing roller 120 includes a core 122 made of a material such as aluminum; an elastic layer 123 which is formed on the peripheral surface of the core and which is made of a material such as silicone rubbers; a release layer 124 which is formed on the elastic layer and which is made of a material such as fluorine-containing resins (e.g., PFA·PTFA); and a heater 121 which is located in the core and which serves as a heat source.

Similarly, the pressure roller 130 includes a metal core 132, an elastic layer 133, a release layer 134 and a heater 131. The pressure roller 130 is pressure-contacted with the fixing roller 120 by a pressing device (not shown). Thus, the fixing roller 120 and the pressure roller 130 rotate while forming the nip N therebetween.

Thermistors 125 and 135 each serving as a temperature detector are set on the surfaces of the fixing roller 120 and the pressure roller 130, respectively. The temperatures of the fixing roller 120 and the pressure roller 130 are controlled so as to be the target temperatures by a heater driving circuit (not shown) on the basis of the information on the temperatures measured by the thermistors 125 and 135.

After the fixing roller 120 and the pressure roller 130 are heated to the target temperatures, the receiving sheet S bearing the toner image T is fed through the nip N of the fixing device 119. In this case, the toner image T on the sheet S is fixed to the sheet S upon application of heat and pressure thereto.

Fixing devices for use in color image forming apparatuses preferably include a fixing roller having an elastic layer. When a fixing roller having no elastic layer is used for such fixing devices, the surface of the fixing roller is unevenly contacted with the surface of a color toner image, which typically has a rough surface because of including a color image formed of one toner layer and another color image formed of two or more toner layers, resulting in formation of a fixed toner image having uneven glossiness. By using a fixing roller having an elastic layer, occurrence of such a problem can be prevented. This is because the hardness of the surface of the fixing roller is decreased and therefore the surface of the fixing roller is evenly contacted with the surface of a color toner image (i.e., the color toner image is contacted with the surface of the fixing roller) while wrapped therewith.

By using such a fixing device, multi-color toner images can be well fixed.

2. Example of Heat Film Fixing Device

Figure 2:
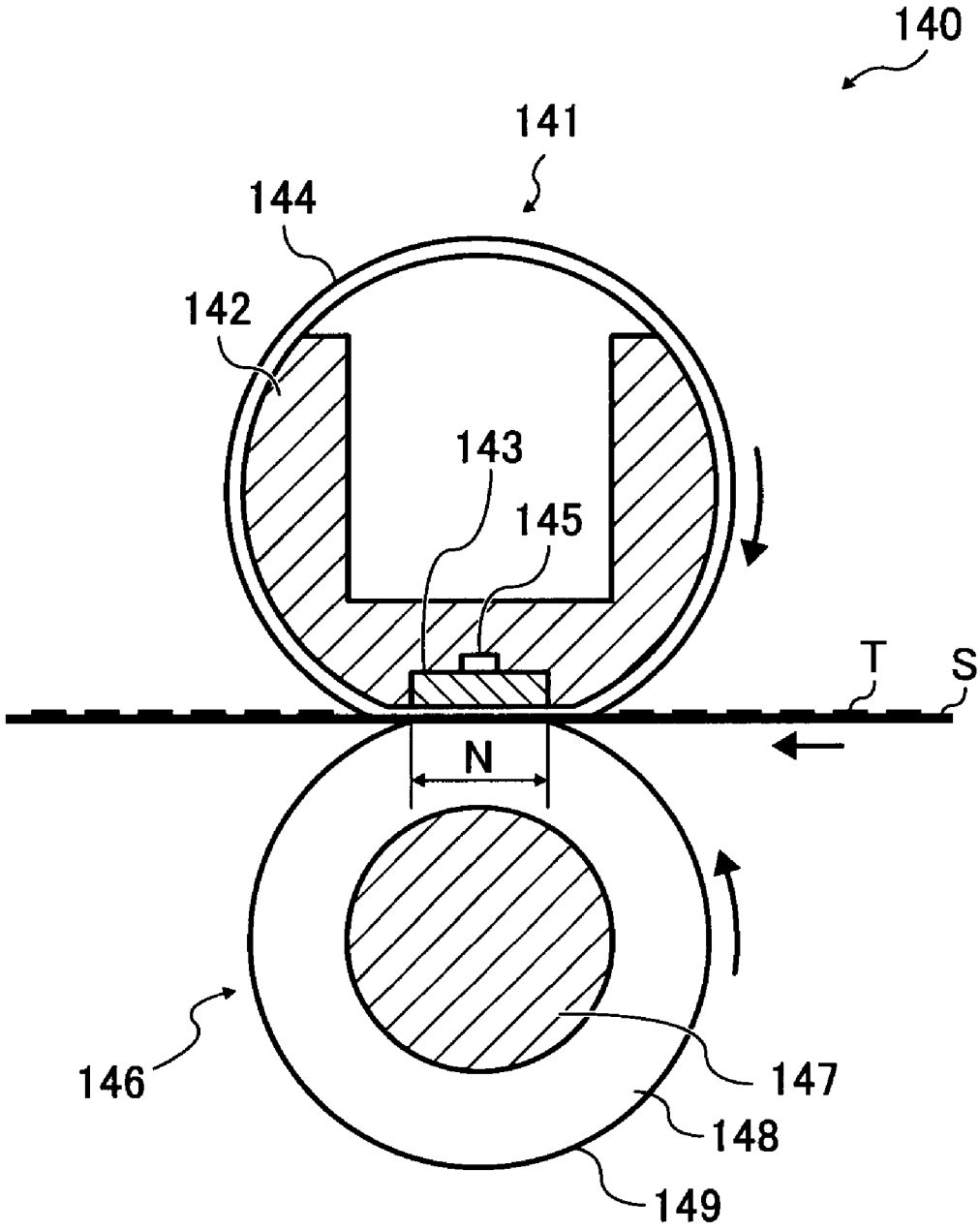

An example of heat film fixing devices for use in monochrome image forming apparatuses is illustrated in FIG. 2. Referring to FIG. 2, a heat film fixing device 140 includes a heating unit 141 and a pressure roller 146. The heating unit 141 includes a film guide 142 both ends of which are fixedly supported, a ceramic heater 143 which serves as a heat source and which is provided on the film guide 142, and a cylindrical film 144 which is loosely wound around the peripheral surface of the combination of the film guide 142 and the ceramic heater 143 and which rotates.

The ceramic heater 143 includes a substrate made of a ceramic such as alumina, an electroconductive heat generation layer formed on one side of the substrate, a thermistor 145 which is configured to control the temperature of the ceramic heater and which is provided on the other side of the substrate, and an insulating layer made of a heat resistant glass which covers the thermistor.

The film 144 is made of a heat resistant film, such as polyimide films, on the surface of which a release layer made of a material such as fluorine-containing resins is formed to prevent toner particles from adhering to the film.

The pressure roller 146 is pressure-contacted with the ceramic heater 143 with the film 144 therebetween, thereby forming a nip N therebetween. The pressure roller 146 includes a core 147 made of a metal such as aluminum, an elastic layer 148 formed on the core and made of a material such as silicone rubbers, and a release layer 149 formed on the elastic layer and made of a material such as PFA.

The cylindrical film 144 is rotated clockwise while being contacted with the lower surface of the ceramic heater and driven by the pressure roller 146, which is rotated counterclockwise by a driving device (not shown).

When the receiving sheet S bearing the unfixed toner image T is passed through the nip N formed by the film 144 and the pressure roller 146, the toner image T is fixed to the receiving sheet S by the heat of the ceramic heater and the pressure of the pressure roller 146.

Since the surface of the pressure roller 146 is heated by the ceramic heater through the film 144 having a very small heat capacity, the surface is rapidly heated to a target temperature. Therefore, the warm-up time can be decreased to an extent such that it is not necessary to perform preliminary heating on the fixing device.

Hereinbefore, examples of the fixing device for use in the image forming apparatus of the present invention are explained by reference to FIGS. 1 and 2, but the fixing device is not limited thereto and various changes and modifications can be made thereto. For example, the method for supporting or pressing the film in the heat film fixing device can be modified. In addition, the number of heaters used for the fixing devices can be changed.

In the image forming apparatus of the present invention, the fixing pressure P(N/cm$^2$) applied to the receiving material (i.e., the toner image) at the nip N is decreased as much as possible. Therefore, occurrence of problems such that the fixing member is deteriorated, scratched and/or abraded can be prevented. Therefore, the life of the fixing member can be extended. When the fixing pressure P is decreased, a film or belt cannot apply a sufficient energy to a toner image constituted of a toner (or toners) having a small particle diameter, which is used for forming high quality (color) images, resulting in formation of images having poor fixing property and low glossiness.

In view of image quality, the toner preferably satisfies the following relationship (1):

$$2.0\ \mu m \leqq D4 \leqq 4.5\ \mu m \quad (1).$$

wherein D4 represents the weight average particle diameter of the toner.

When the weight average particle diameter is too small, the cleanability of the toner deteriorates, thereby causing a background development problem in that the background of an image is soiled with toner particles remaining on an image bearing member without being transferred. In contrast, when the weight average particle diameter is too large, image qualities (such as dot reproducibility and granularity) deteriorate.

Further, in order to produce high quality images while extending the life of the fixing member, not only the relationship (1) but also the following relationships (2) and (3) are preferably satisfied.

$$P \leqq 15\ N/cm^2 \quad (2), \text{ and}$$

$$P \times D4 \geqq 30\ N/cm^2 \cdot \mu m \quad (3),$$

wherein P represents the pressure applied to the receiving material.

Even when the relationships (1), (2) and (3) are satisfied, sufficient energy and pressure to well fix a toner image constituted of a toner having a small particle diameter cannot be applied.

As a result of the present inventor's study, it is found that when the below-mentioned relationships (4)-(6) are satisfied, the resultant fixed images have good fixing property and high glossiness.

$$3{,}000\ Pa \cdot s \leqq Gw110 \leqq 40{,}000\ Pa \cdot s \quad (4),$$

$$100\ Pa \cdot s \leqq Gw140 \leqq 1{,}000\ Pa \cdot s \quad (5), \text{ and}$$

$$Gw110/Gw140 \geqq 30 \quad (6),$$

wherein Gw110 and Gw140 represent the melt viscosities of the toner at 110 and 140° C., respectively.

Namely, the melt viscosity of the toner for use in the image forming method and apparatus of the present invention rapidly decreases at a high temperature (140° C.) compared to conventional toners. Therefore, even when the toner has a small particle diameter and an image of the toner is fixed under a low pressure, the resultant fixed image has good fixing property and high glossiness.

When Gw110 or Gw140 is too small, the toner has too low a melt viscosity, and therefore the offset problem tends to occur. In contrast, when Gw110 or Gw140 is too large, the fixing property of the fixed images deteriorates.

The viscosities Gw110 and Gw140 are measured by a flow tester (FLOW TESTER CFT500 from Shimadzu Corp.). The measuring method is as follows:

At first, about one gram of a sample (toner) is pressed by a pressing device to prepare a pellet. The pellet is set in a cylinder of the flow tester and heated at a predetermined temperature rising speed. When the sample is heated and melted, the plunger pressing the sample in the cylinder falls. The relationship between the temperature and the falling amount of the plunger (i.e., the amount of the sample flowing out) is recorded. The melt viscosity (η') of the sample is determined using the following equation.

$$\eta' = TW'/DE' = \pi PR^4/8LQ\ (Pa \cdot s)$$

wherein TW' represents the apparent shear stress of the wall of the cylinder and is equal to PR/2L (N m$^2$), DW' represents the apparent shear speed of the wall of the cylinder and is equal to $4Q/\pi PR^3$ ($sec^{-1}$), Q represents the flow speed of the sample in units of $m^3$/sec, P represents the pressing pressure of the plunger ($N/m^2$), R represents the radius of the die in units of meter, and L represents the length of the die in units of meter.

The measuring conditions are as follows.

Load: 30 $kg/cm^2$,

Temperature rising speed: 3.0° C./min,

Diameter of die: 0.50 mm, and

Length of die: 1.0 mm.

The ratio (D4/Dn) of the weight average particle diameter (D4) to the number average particle diameter (Dn) of the toner for use in the present invention preferably satisfies the following relationship (7):

$$1.05 \leqq D4/Dn \leqq 1.25 \quad (7).$$

When the toner satisfies the relationship (7), i.e., when the toner has a sharp particle diameter distribution, images having good fixing property can be produced without causing the background development problem.

The weight average particle diameter and the number average particle diameter of a toner are measured by an instrument such as COULTER COUNTER TA-II manufactured by Beckman Coulter Inc.

The procedure is as follows:

(1) a surfactant serving as a dispersant, preferably 0.1 to 5 ml of a 1% aqueous solution of an alkylbenzenesulfonic acid salt, is added to 100-150 ml of an electrolyte such as 1% aqueous solution of first class NaCl (in this case ISOTON-II manufactured by Beckman Coulter Inc. is used);

(2) 2 to 20 mg of a sample to be measured is added into the mixture;

(3) the mixture is subjected to an ultrasonic dispersion treatment for about 1 to 3 minutes; and (4) the volume particle diameter distribution and number particle diameter distribution of the sample are determined using the instrument and an aperture of 100 μm to determine the weight average particle diameter and the number average particle diameter.

In the present invention, the following 13 channels are used:

(1) not less than 1.26 μm and less than 1.59 μm;

(2) not less than 1.59 μm and less than 2.00 μm;

(3) not less than 2.00 μm and less than 2.52 μm;

(4) not less than 2.52 μm and less than 3.17 μm;

(5) not less than 3.17 μm and less than 4.00 μm;

(6) not less than 4.00 μm and less than 5.04 μm;

(7) not less than 5.04 μm and less than 6.35 μm;

(8) not less than 6.35 μm and less than 8.00 μm;

(9) not less than 8.00 μm and less than 10.08 μm;

(10) not less than 10.08 μm and less than 12.70 μm;

(11) not less than 12.70 μm and less than 16.00 μm; and

(12) not less than 16.00 μm and less than 20.20 μm.

Namely, particles having a particle diameter of from 1.26 μm to 20.20 μm are targeted.

The (color) toner for use in the image forming apparatus of the present invention preferably has a glass transition temperature (Tg) of from 40 to 55° C. In this case, the fixed images have good fixing property even when the toner has a small particle diameter and the pressure applied to a receiving material at the nip N is low. When the glass transition temperature is too low, the preservability of the toner deteriorates. In contrast, when the glass transition temperature is too high, the toner has poor fixing property.

The glass transition temperature (Tg) of a toner can be measured with a TG-DSC System TAS-100 from Rigaku Corporation. The method is as follows.

(1) about 10 mg of a sample which is contained in an aluminum container is set on a holder unit, and the holder unit is set in an electric furnace;

(2) the sample is heated from room temperature to 150° C. at a temperature rising speed of 10° C./min, followed by heating at 150° C. for 10 minutes and cooling to room temperature; and (3) after the sample is allowed to settle at room temperature for 10 minutes, the sample is heated again from room temperature to 150° C. at a temperature rising speed of 10° C./min to obtain a DSC curve.

The glass transition temperature (Tg) of the sample is determined using an analyzing system of TAS-100. The glass transition temperature is defined as the temperature at which the tangent line of the endothermic curve crosses the base line. This system can automatically draw the base line and output the glass transition temperature (Tg) of the sample.

The (color) toner for use in the image forming apparatus of the present invention preferably includes a crystalline polyester as a binder resin. The crystalline polyester preferably has a melting point of from 80 to 130° C., and more preferably from 90 to 125° C. When the melting point of the crystalline polyester is too low, the preservability of the toner deteriorates. When the melting point is too high, the fixing property of the toner deteriorates.

The (color) toner for use in the image forming apparatus of the present invention preferably includes a release agent having a melting point of from 60 to 80° C. In this case, the offset problem is hardly caused even when the toner has a small particle diameter and the pressure applied to a receiving material at the nip N is low. When the melting point of the release agent is too low, the preservability of the toner deteriorates. When the melting point is too high, the offset problem is easily caused.

The melting point of a release agent can be measured by differential scanning colorimetry (DSC), and is defined as the temperature at which the DSC curve has a maximum endothermic peak. A combination of TA-60W and DSC-60 from Shimadzu Corp. is used as the measuring instrument. The measuring conditions are as follows.

Sample container: sample pan made of aluminum with cap

Amount of sample: 5 mg

Reference sample: 10 mg of alumina contained in an aluminum pan

Atmosphere: Nitrogen (flow rate of 50 ml/min)

Temperature Conditions (first temperature rising operation)

Starting temp.: 20° C.

Temp. rising speed: 10° C./min

End temp.: 150° C.

Retention time at end temp.: 0

(first cooling operation)

Cooling speed: 10° C./min

End temp.: 20° C.

Retention time at end temp.: 0

(second temperature rising operation)

Temp. rising speed: 10° C./min

End temp.: 150° C.

The measurement data are analyzed by an analyzing software TA-60 version 1.52 from Shimadzu Corp. The analyzing method is as follows:

(1) The temperature range (±5° C.) of the maximum peak of the DrDSC curve which is a differential curve of the sample in the second temperature rising operation is input to the analyze to determine the peak temperature of the DSC curve; and (2) The maximum endothermic peak temperature of the sample is determined by analyzing the DSC curve in the temperature range (±5° C.) of the peak temperature using the analyzing software.

In this regard, the thus determined maximum endothermic peak temperature is the melting point of the sample.

The content of the release agent in the toner is preferably from 3 to 10 parts by weight per 100 parts by weight of the binder resin. In this case, the offset problem is hardly caused even when the toner has a small particle diameter and the pressure applied to a receiving material at the nip N is low. When the content of the release agent is too low, the offset problem is easily caused. When the content is too high, a filming problem in that a film of the release agent is formed on the members of the developing device and the image bearing member, resulting in deterioration of image qualities occurs.

The (color) toner for use in the image forming apparatus of the present invention is preferably a spherical toner having an average particle diameter. In order to prepare such a spherical toner, toner preparation methods in which an oil phase liquid is emulsified, suspended or aggregated in an aqueous medium, such as suspension polymerization methods, emulsion polymerization methods, and polymer suspension methods are preferably used.

Hereinafter, the toner preparation methods, and the toner constituents will be explained.

(Suspension Polymerization Method)

At first, a colorant, a release agent, etc. are dispersed in a mixture of a polymerizable monomer and an oil-soluble polymerization initiator. The dispersion is dispersed in an aqueous medium including a surfactant and/or a solid dispersant to prepare an emulsion by the below-mentioned emulsifying method. Then the emulsion is subjected to a polymerization reaction to prepare toner particles. A particulate inorganic material is adhered to the toner particles by a wet method preferably after the toner particles are washed to remove excess surfactant and dispersant.

In order to incorporate a functional group into the surface of the toner particles, it is preferable to use one or more monomers having a functional group, such as acids (e.g., acrylic acid, methacrylic acid, α-cyanoacrylic acid, α-cyanomethacrylic acid, itaconic acid, crotonic acid, fumaric acid, maleic acid and maleic anhydride); and (meth) acrylic monomers having an amino group (e.g., acrylamide, methacrylamide, diacetoneacrylamide, their methylol compounds, vinyl pyridine, vinyl pyrrolidone, vinyl imidazole, ethylene imine, and dimethylaminoethyl methacrylate) in combination with polymerizable monomers.

It is also preferable to incorporate a functional group into the surface of the toner particles by using a dispersant having an acidic group or a basic group, which is adsorbed on the toner particles.

(Emulsion Polymerization Aggregation Method)

A water-soluble polymerization initiator and a polymerizable monomer are emulsified in water using a surfactant. The emulsion is subjected to emulsion polymerization to prepare a latex. On the other hand, a colorant, a release agent, etc. are dispersed in an aqueous medium to prepare a dispersion. The dispersion is mixed with the latex to aggregate the particles to an extent such that the aggregated particles have a toner size, followed by heating to fuse the aggregated particles. By using one or more of the above-mentioned monomers having a functional group for the polymerizable monomer, a functional group can be incorporated into the surface of the toner particles.

(Polymer Suspension Method)

Toner constituents, e.g., a resin, a prepolymer, a colorant (such as pigments), a release agent and a charge controlling agent are dissolved or dispersed in a volatile solvent to prepare an oil phase liquid.

The oil phase liquid is dispersed in an aqueous medium including a surfactant and/or a solid dispersant, followed by reaction of the prepolymer, resulting in preparation of toner particles.

Suitable materials for use as the aqueous medium include water, and mixture of water and one or more solvents which can be mixed with water. Specific examples of the solvents include alcohols (e.g., methanol, isopropanol, and ethylene glycol), dimethylformamide, tetrahydrofuran, cellosolves (e.g., methyl cellosolve), lower ketones (e.g., acetone, and methyl ethyl ketone), etc.

In order to incorporate a functional group into the surface of the toner particles, for example, the following methods can be used.

(1) A copolymer prepared by using one or more of the monomers mentioned above for use in the suspension polymerization method is used;

(2) A polyester resin prepared by using an acid having three or more functional groups is used;

(3) A polyester resin in which the hydroxyl group at the end portion thereof is reacted with a compound having plural acidic groups to be esterified is used; and (4) A surfactant, a polar polymer, and/or a particulate organic or inorganic material, which have an acid group (e.g., carboxyl groups, sulfonic groups, and phosphate groups) are used as a dispersion stabilizer for the aqueous medium.

The toner for use in the image forming apparatus of the present invention is prepared, for example, by using the following materials and preparation methods.

(Modified Polyester)

The toner for use in the image forming apparatus of the present invention preferably includes a modified polyester resin (i). In this application, the modified polyester resin is defined as a polyester resin which has a bond other than the ester bond or which includes therein another resin component which is bonded with the polyester resin component by a covalent bond, ionic bond or other bond. Specifically, the modified polyester resin is defined as a modified polyester resin prepared by incorporating a group such as an isocyanate group, which is reactive with a carboxyl group, and a hydroxyl group, at an end portion thereof, and then reacting the group with a compound having an active hydrogen atom.

Suitable modified polyester resins for use in the toner in the present invention include urea-modified polyester resins which are prepared by reacting a polyester prepolymer (A) having an isocyanate group with an amine (B). Polyester prepolymers (A) can be prepared by a polycondensation product of a polyol (PO) and a polycarboxylic acid (PC) (i.e., a polyester resin having a group including an active hydrogen atom) with a polyisocyanate (PIC). Specific examples of the group including an active hydrogen atom include hydroxyl groups (alcoholic hydroxyl group and phenolic hydroxyl group), amino groups, carboxyl groups, mercapto groups, etc. Among these groups, the alcoholic hydroxyl group is preferable.

Suitable polyols (PO) for use in preparing the modified polyester resin include diols (DIO), polyols (TO) having three or more hydroxyl groups, and mixtures of DIO and TO.

Preferably, diols (DIO) alone or mixtures of a diol (DIO) and a small amount of polyol (TO) are used.

Specific examples of the diols (DIO) include alkylene glycols, alkylene ether glycols, alicyclic diols, bisphenols, alkylene oxide adducts of alicyclic diols, alkylene oxide adducts of bisphenols, etc.

Specific examples of the alkylene glycols include ethylene glycol, 1,2-propylene glycol, 1,3-propylene glycol, 1,4-butanediol and 1,6-hexanediol. Specific examples of the alkylene ether glycols include diethylene glycol, triethylene glycol, dipropylene glycol, polyethylene glycol, polypropylene glycol and polytetramethylene ether glycol. Specific examples of the alicyclic diols include 1,4-cyclohexane dimethanol and hydrogenated bisphenol A. Specific examples of the bisphenols include bisphenol A, bisphenol F and bisphenol S. Specific examples of the alkylene oxide adducts of alicyclic diols include adducts of the alicyclic diols mentioned above with an alkylene oxide (e.g., ethylene oxide, propylene oxide and butylene oxide). Specific examples of the alkylene oxide adducts of bisphenols include adducts of the bisphenols mentioned above with an alkylene oxide (e.g., ethylene oxide, propylene oxide and butylene oxide).

Among these compounds, alkylene glycols having from 2 to 12 carbon atoms and alkylene oxide adducts of bisphenols are preferable. More preferably, alkylene oxide adducts of bisphenols, and mixtures of an alkylene oxide adduct of a bisphenol and an alkylene glycol having from 2 to 12 carbon atoms are used.

Specific examples of the polyols (TO) include aliphatic alcohols having three or more hydroxyl groups (e.g., glycerin, trimethylol ethane, trimethylol propane, pentaerythritol and sorbitol); polyphenols having three or more hydroxyl groups (trisphenol PA, phenol novolak and cresol novolak); adducts of the polyphenols mentioned above with an alkylene oxide such as ethylene oxide, propylene oxide and butylene oxide; etc.

Suitable polycarboxylic acids (PC) for use in preparing the modified polyester resin include dicarboxylic acids (DIC) and polycarboxylic acids (TC) having three or more carboxyl groups. Preferably, dicarboxylic acids (DIC) alone and mixtures of a dicarboxylic acid (DIC) with a small amount of polycarboxylic acid (TC) are used.

Specific examples of the dicarboxylic acids (DIC) include alkylene dicarboxylic acids (e.g., succinic acid, adipic acid and sebacic acid); alkenylene dicarboxylic acids (e.g., maleic acid and fumaric acid); aromatic dicarboxylic acids (e.g., phthalic acid, isophthalic acid, terephthalic acid and naphthalene dicarboxylic acids; etc. Among these compounds, alkenylene dicarboxylic acids having from 4 to 20 carbon atoms and aromatic dicarboxylic acids having from 8 to 20 carbon atoms are preferably used.

Specific examples of the polycarboxylic acids (TC) having three or more hydroxyl groups include aromatic polycarboxylic acids having from 9 to 20 carbon atoms (e.g., trimellitic acid and pyromellitic acid).

When a polycarboxylic acid (PC) is reacted with a polyol (PO), anhydrides or lower alkyl esters (e.g., methyl esters, ethyl esters or isopropyl esters) of the polycarboxylic acids mentioned above can also be used as the polycarboxylic acid (PC) Suitable mixing ratio (i.e., the equivalence ratio [OH]/[COOH]) of the [OH] group of a polyol (PO) to the [COOH] group of a polycarboxylic acid (PC) is from 2/1 to 1/1, preferably from 1.5/1 to 1/1 and more preferably from 1.3/1 to 1.02/1.

Specific examples of the polyisocyanates (PIC) for use in preparing the modified polyester resin include aliphatic polyisocyanates (e.g., tetramethylene diisocyanate, hexamethylene diisocyanate and 2,6-diisocyanate methylcaproate); alicyclic polyisocyanates (e.g., isophorone diisocyanate and cyclohexylmethane diisocyanate); aromatic diisocianates (e.g., tolylene diisocyanate and diphenylmethane diisocyanate); aromatic aliphatic diisocyanates (e.g., α, α, α', α'-tetramethyl xylylene diisocyanate); isocyanurates; blocked polyisocyanates in which the polyisocyanates mentioned above are blocked with phenol derivatives, oximes or caprolactams; etc. These compounds can be used alone or in combination.

Suitable mixing ratio (i.e., the equivalence ratio [NCO]/[OH]) of the [NCO] group of a polyisocyanate (PIC) to the [OH] group of a polyester is from 5/1 to 1/1, preferably from 4/1 to 1.2/1 and more preferably from 2.5/1 to 1.5/1. When the [NCO]/[OH] ratio is too large, the low temperature fixability of the toner deteriorates. In contrast, when the ratio is too small, the content of the urea group in the modified polyesters decreases, thereby deteriorating the hot-offset resistance of the toner.

The content of the polyisocyanate unit in the polyester prepolymer (A) having an isocyanate group is from 0.5 to 40% by weight, preferably from 1 to 30% by weight and more preferably from 2 to 20% by weight. When the content is too low, the hot offset resistance of the toner deteriorates and in addition a good combination of preservability and low temperature fixability cannot be imparted to the resultant toner. In contrast, when the content is too high, the low temperature fixability of the toner deteriorates.

The average number of the isocyanate group included in a molecule of the polyester prepolymer (A) is generally not less than 1, preferably from 1.5 to 3, and more preferably from 1.8 to 2.5. When the average number of the isocyanate group is too small, the molecular weight of the resultant urea-modified polyester (which is crosslinked and/or extended) decreases, thereby deteriorating the hot offset resistance of the resultant toner.

The urea-modified polyester resin for use as a binder resin of the toner of the present invention can be prepared by reacting a polyester prepolymer (A) having an isocyanate group with an amine (B).

Specific examples of the amines (B) include diamines (B1), polyamines (B2) having three or more amino groups, amino alcohols (B3), aminomercaptans (B4), aminoacids (B5) and blocked amines (B6) in which the amines (B1-B5) mentioned above are blocked. These amines can be used alone or in combination.

Specific examples of the diamines (B1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diaminocyclohexane and isophorone diamine); aliphatic diamines (e.g., ethylene diamine, tetramethylene diamine and hexamethylene diamine); etc.

Specific examples of the polyamines (B2) having three or more amino groups include diethylene triamine, triethylene tetramine, etc. Specific examples of the amino alcohols (B3) include ethanol amine, hydroxyethyl aniline, etc. Specific examples of the amino mercaptan (B4) include aminoethyl mercaptan, aminopropyl mercaptan, etc. Specific examples of the amino acids (B5) include amino propionic acid, amino caproic acid, etc. Specific examples of the blocked amines (B6) include ketimine compounds which are prepared by reacting one of the amines (B1-B5) mentioned above with a ketone such as acetone, methyl ethyl ketone and methyl isobutyl ketone; oxazoline compounds, etc. Among these amines, diamines (B1) and mixtures of a diamine (B1) with a small amount of a polyamine (B2) are preferably used.

The molecular weight of the urea-modified polyesters can be controlled using a molecular chain extension inhibitor, if desired. Specific examples of the molecular chain extension inhibitor include monoamines (e.g., diethyl amine, dibutyl amine, butyl amine and lauryl amine), and blocked amines (i.e., ketimine compounds) prepared by blocking the monoamines mentioned above.

The mixing ratio (i.e., the equivalence ratio [NCO]/[NHx]) of the [NCO] group of the prepolymer (A) having an isocyanate group to the [NHx] group of the amine (B) is from 1/2 to 2/1, preferably from 1/1.5 to 1.5/1 and more preferably from 1/1.2 to 1.2/1. When the mixing ratio is too low or too high, the molecular weight of the resultant urea-modified polyester decreases, resulting in deterioration of the hot offset resistance of the resultant toner.

The urea-modified polyester resins for use in the toner can include a urethane bonding as well as a urea bonding. The molar ratio of the urea bonding to the urethane bonding is from 100/0 to 10/90, preferably from 80/20 to 20/80, and more preferably from 60/40 to 30/70. When the molar ratio of the urea bonding is too low, the hot offset resistance of the resultant toner deteriorates.

The modified polyesters (i) can be prepared, for example, by a method such as one-shot methods or prepolymer methods. The weight average molecular weight of the modified polyesters (i) is generally not less than 10,000, preferably from 20,000 to 1,000,000 and more preferably from 30,000 to 1,000,000. When the weight average molecular weight is too low, the polyester resins are hardly subjected to a molecular chain extension reaction, and thereby the resultant toner has poor elasticity. As a result, the hot offset resistance of the resultant toner deteriorates. In contrast, when the molecular weight is too high, the fixability of the toner deteriorates. In addition, the productivity of the toner deteriorates, specifically, the efficiency in a granulation process or a pulverization process deteriorates.

The number average molecular weight of the modified polyester resin (i) is not particularly limited if an unmodified polyester resin (ii) is used in combination therewith. Specifically, the weight average molecular weight of the modified polyester resin is mainly controlled rather than the number average molecular weight. When the modified polyester resin is used alone, the number average molecular weight of the resin is preferably not greater than 20,000, preferably from 1,000 to 10,000, and more preferably from 2,000 to 8,000. When the number average molecular weight is too high, the low temperature fixability of the resultant toner deteriorates. In addition, when the toner is used as a color toner, the resultant toner has low glossiness.

The modified polyester resin (i) is prepared by subjecting a polyester prepolymer (A) to a crosslinking reaction and/or a molecular chain extension reaction using an amine (B). In this case, a reaction inhibitor can be used to control the molecular weight of the resultant modified polyester resin. Suitable materials for use as the reaction inhibitor include monoamines such as diethyl amine, dibutyl amine, butyl amine and lauryl amine, and blocked amines of the monoamines such as ketimine compounds.

(Unmodified Polyester)

In the present invention, it is preferable to use a combination of a modified polyester resin (i) with an unmodified polyester resin (ii) as the binder resin of the toner. By using such a combination, the low temperature fixability of the toner can be improved and in addition the toner can produce color images having a high glossiness.

Suitable materials for use as the unmodified polyester resin (ii) include polycondensation products of a polyol (PO) with a polycarboxylic acid (PC). Specific examples of the polyol (PO) and polycarboxylic acid (PC) are mentioned above for use in the modified polyester resin (i). In addition, specific examples of the suitable polyol and polycarboxylic acid are also mentioned above.

In addition, polyester resins modified by a bonding (such as urethane bonding) other than a urea bonding are considered as the unmodified polyester resin (ii) in the present application.

When a combination of a modified polyester resin (i) with an unmodified polyester resin (ii) is used as the binder resin, it is preferable that the modified polyester resin is at least partially mixed with the unmodified polyester resin to improve the low temperature fixability and hot offset resistance of the toner. Namely, it is preferable that the modified polyester resin has a molecular structure similar to that of the unmodified polyester resin. The mixing ratio (i/ii) of a modified polyester resin (i) to an unmodified polyester resin (ii) is from 5/95 to 80/20, preferably from 5/95 to 30/70, more preferably from 5/95 to 25/75, and even more preferably from 7/93 to 20/80. When the added amount of the modified polyester resin is too small, the hot offset resistance of the toner deteriorates and in addition, it is impossible for the toner to achieve a good combination of high temperature preservability and low temperature fixability.

The peak molecular weight of the unmodified polyester resin (ii) is from 1,000 to 10,000, preferably from 2,000 to 8,000 and more preferably from 2,000 to 5,000. When the peak molecular weight is too low, the high temperature preservability of the toner deteriorates. In contrast, when the peak molecular weight is too high, the low temperature fixability of the toner deteriorates.

The unmodified polyester resin (ii) preferably has a hydroxyl value not less than 5 mgKOH/g, and more preferably from 10 to 120 mgKOH/g, and even more preferably from 20 to 80 mgKOH/g. When the hydroxyl value is too small, the resultant toner has poor high temperature preservability and poor low temperature fixability.

The unmodified polyester resin (i) preferably has an acid value of from 1 to 5 mgKOH/g, and more preferably from 2 to 4 mgKOH/g. When a wax having a high acid value is used as a release agent while a resin having a relatively low acid value is used as a binder resin, good charge properties and high volume resistivity can be imparted to the toner. The thus prepared toner can be preferably used for two component developers.

(Colorant)

The toner for use in the image forming apparatus of the present invention includes a colorant. Suitable materials for use as the colorant include known dyes and pigments.

Specific examples of the dyes and pigments include carbon black, Nigrosine dyes, black iron oxide, NAPHTHOL YELLOW S, HANSA YELLOW 10G, HANSA YELLOW 5G, HANSA YELLOW G, Cadmium Yellow, yellow iron oxide, loess, chrome yellow, Titan Yellow, polyazo yellow, Oil Yellow, HANSA YELLOW GR, HANSA YELLOW A, HANSA YELLOW RN, HANSA YELLOW R, PIGMENT YELLOW L, BENZIDINE YELLOW G, BENZIDINE YELLOW GR, PERMANENT YELLOW NCG, VULCAN FAST YELLOW 5G, VULCAN FAST YELLOW R, Tartrazine Lake, Quinoline Yellow LAKE, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED F2R, PERMANENT RED F4R, PERMANENT RED FRL, PERMANENT RED FRLL, PERMANENT RED F4RH, Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE RS, INDANTHRENE BLUE BC, Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

The content of the colorant in the toner is preferably from 1 to 15% by weight, and more preferably from 3 to 10% by weight of the toner.

Master batches, which are complexes of a colorant with a resin, can be used as the colorant of the toner for use in the present invention.

Specific examples of the resins for use as the binder resin of the master batches include polymers of styrene or styrene derivatives (e.g., polystyrene, poly-p-chlorostyrene, and polyvinyl toluene), copolymers of styrene or styrene derivatives with vinyl monomers, polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, polyacrylic acid resins, rosin, modified rosins, terpene resins, aliphatic or alicyclic hydrocarbon resins, aromatic petroleum resins, chlorinated paraffin, paraffin waxes, etc. These can be used alone or in combination.

(Charge Controlling Agent)

The toner for use in the image forming apparatus of the present invention preferably includes a charge controlling agent. Any known charge controlling agents can be used for the toner.

Suitable examples of the charge controlling agents include Nigrosine dyes, triphenyl methane dyes, chromium-containing metal complex dyes, molybdic acid chelate pigments, Rhodamine dyes, alkoxyamines, quaternary ammonium salts, fluorine-modified quaternary ammonium salts, alkylamides, phosphor and its compounds, tungsten and its compounds, fluorine-containing activators, metal salts of salicylic acid, metal salts of salicylic acid derivatives, etc. These materials can be used alone or in combination.

Specific examples of the marketed charge controlling agents include BONTRON® 03 (Nigrosine dye), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE® PSY VP2038 (quaternary ammonium salt), COPYBLUE® (triphenylmethane derivative), COPY CHARGE® NEG VP2036 and COPY CHARGE® NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments, and polymers having a functional group such as a sulfonate group, a carboxyl group, a quaternary ammonium group, etc.

The content of the charge controlling agent in the toner of the present invention is determined depending on the variables such as choice of binder resin, presence of additives, and dispersion method. In general, the content of the charge controlling agent is preferably from 0.1 to 10 parts by weight, and more preferably from 0.2 to 5 parts by weight, per 100 parts by weight of the binder resin included in the toner. When the content is too high, the charge quantity of the toner excessively increases, and thereby the electrostatic attraction between the developing roller and the toner increases, resulting in deterioration of fluidity and decrease of image density.

(Release Agent)

The toner for use in the image forming apparatus of the present invention can include a release agent. Suitable release agents include waxes having a melting point of from 50 to 120° C., and preferably from 60 to 80° C. When such a wax is included in the toner, the wax is dispersed in the binder resin and serves as a release agent while being present at a location between a fixing roller and the toner particles in the fixing process. Thereby the hot offset problem can be avoided without applying an oil to the fixing roller used.

Specific examples of the release agent include natural waxes such as vegetable waxes, e.g., carnauba wax, cotton wax, Japan wax and rice wax; animal waxes, e.g., bees wax and lanolin; mineral waxes, e.g., ozokelite and ceresine; and petroleum waxes, e.g., paraffin waxes, microcrystalline waxes and petrolatum. In addition, synthesized waxes can also be used. Specific examples of the synthesized waxes include synthesized hydrocarbon waxes such as Fischer-Tropsch waxes and polyethylene waxes; and synthesized waxes such as ester waxes, ketone waxes and ether waxes. Further, fatty acid amides such as 1,2-hydroxylstearic acid amide, stearic acid amide and phthalic anhydride imide; and low molecular weight crystalline polymers such as acrylic homopolymer and copolymers having a long alkyl group in their side chain, e.g., poly-n-stearyl methacrylate, poly-n-laurylmethacrylate and n-stearyl acrylate-ethyl methacrylate copolymers, can also be used.

The above-mentioned charge controlling agent and release agent can be kneaded with a master batch and a binder resin. Alternatively, the charge controlling agent and the release agent can be added to an organic solvent when the toner composition liquid is prepared.

(External Additive)

A particulate inorganic material is typically mixed with toner particles to assist in improving the fluidity, developing property and charging ability of the toner particles. It is preferable for the particulate inorganic materials to have a primary particle diameter of from 5 nm to 2 μm, and more preferably from 5 nm to 500 nm. In addition, it is preferable that the specific surface area of such particulate inorganic materials measured by a BET method is from 20 to 500 $m^2/g$. The content of the external additive is preferably from 0.01 to 5% by weight, and more preferably from 0.01 to 2.0% by weight, based on total weight of the toner composition.

Specific examples of such particulate inorganic materials include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc.

Particles of a polymer such as polystyrene, polymethacrylates, and polyacrylate copolymers, which are prepared by a polymerization method such as soap-free emulsion polymerization methods, suspension polymerization methods and dispersion polymerization methods; particles of a polymer such as silicone, benzoguanamine and nylon, which are prepared by a polymerization method such as polycondensation methods; and particles of a thermosetting resin, can also be used as the external additive of the toner for use in the present invention.

The external additive used for the toner is preferably subjected to a hydrophobizing treatment to prevent deterioration of the fluidity and charge properties of the resultant toner particularly under high humidity conditions. Suitable hydrophobizing agents for use in the hydrophobizing treatment include silane coupling agents, silylating agents, silane coupling agents having a fluorinated alkyl group, organic titanate coupling agents, aluminum coupling agents, silicone oils, modified silicone oils, etc. Among these hydrophobized external additives, hydrophobized silica and hydrophobized titanium oxide are preferably used.

Then the method for preparing toner particles will be explained. The toner particles are typically prepared by the following method, but the preparation method is not limited thereto.

(Toner Preparation Method)

The toner for use in the present invention can be preferably prepared by subjecting a toner composition liquid, which is prepared by dissolving or dispersing toner constituents such as a colorant, an unmodified polyester resin, a prepolymer having a nitrogen-atom-containing group and a release agent in an organic solvent, to a crosslinking reaction and/or a molecular chain growth reaction in an aqueous medium. Specifically, the method is as follows.

(1) Preparation of Toner Composition Liquid

At first, a toner composition liquid is prepared by dissolving or dispersing toner constituents such as a colorant, an unmodified polyester resin, a prepolymer having an isocyanate group and a release agent in an organic solvent. The organic solvent is preferably a volatile solvent having a boiling point less than 100° C. so as to be easily removed from the resultant toner particles. Specific examples of such volatile solvents include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These solvents can be used alone or in combination. In particular, aromatic solvents such as toluene and xylene, and halogenated hydrocarbons such as methylene chloride, 1,2-dichloroethane, chloroform and carbon tetrachloride are preferably used.

The weight ratio of the solvent to the polyester prepolymer is generally from 0/100 to 300/100, preferably from 0/100 to 100/100 and more preferably from 25/100 to 70/100.

(2) Emulsification of the Toner Composition Liquid

The toner composition liquid is then dispersed in an aqueous medium in the presence of a surfactant and a particulate resin to prepare an emulsion. Suitable materials for use as the aqueous medium include water. In addition, organic solvents which can be mixed with water can be added to water. Specific examples of such solvents include alcohols such as methanol, isopropanol, and ethylene glycol; dimethylformamide, tetrahydrofuran, cellosolves such as methyl cellosolve, lower ketones such as acetone and methyl ethyl ketone, etc.

The weight ratio (A/T) of the aqueous medium (A) to the toner composition liquid (T) is generally from 50/100 to 2,000/100 and preferably from 100/100 to 1,000/100. When the added amount of the aqueous medium is too low, the toner composition liquid cannot be well dispersed, and thereby toner particles having a desired particle diameter cannot be prepared. Adding a large amount of aqueous medium is not economical.

When the toner composition liquid is emulsified, a dispersant such as surfactants and particulate resins are preferably included in the aqueous medium.

Specific examples of the surfactants include anionic surfactants such as alkylbenzene sulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi(aminoethyl)glycin, di)octylaminoethyle)glycin, and N-alkyl-N,N-dimethylammonium betaine.

By using a fluorine-containing surfactant as the surfactant, good effects can be produced even when the added amount is small.

Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl (C6-C11)oxy}-1-alkyl(C3-C4) sulfonate, sodium 3-{omega-fluoroalkanoyl(C6-C8)-N-ethylamino}-1-propanesulfonate, fluoroalkyl(C11-C20) carboxylic acids and their metal salts, perfluoroalkyl(C7-C13) carboxylic acids and their metal salts, perfluoroalkyl(C4-C12) sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonyl glycin, monoperfluoroalkyl(C6-C16)ethylphosphates, etc.

Specific examples of the marketed products of such surfactants include SARFRON® S-111, S-112 and S-113, which are manufactured by Asahi Glass Co., Ltd.; FLUORAD® FC-93, FC-95, FC-98 and FC-129, which are manufactured by Sumitomo 3M Ltd.; UNIDYNE® DS-101 and DS-102, which are manufactured by Daikin Industries, Ltd.; MEGAFACE® F-110, F-120, F-113, F-191, F-812 and F-833 which are manufactured by Dainippon Ink and Chemicals, Inc.; ECTOP® EF-102, 103, 104, 105, 112, 123A, 306A, 501, 201 and 204, which are manufactured by Tohchem Products Co., Ltd.; FUTARGENT® F-100 and F150 manufactured by Neos; etc.

Specific examples of the cationic surfactants having a fluoroalkyl group, which can disperse an oil phase including toner constituents in water, include primary, secondary and tertiary aliphatic amines having a fluoroalkyl group, aliphatic quaternary ammonium salts such as perfluoroalkyl(C6-C10)sulfoneamidepropyltrimethylammonium salts, benzalkonium salts, benzetonium chloride, pyridinium salts, imidazolinium salts, etc. Specific examples of the marketed products thereof include SARFRON® S-121 (from Asahi Glass Co., Ltd.); FLUORAD® FC-135 (from Sumitomo 3M Ltd.); UNIDYNE® DS-202 (from Daikin Industries, Ltd.); MEGAFACE® F-150 and F-824 (from Dainippon Ink and Chemicals, Inc.); ECTOP® EF-132 (from Tohchem Products Co., Ltd.); FUTARGENT®F-300 (from Neos); etc.

Particulate resins can be added to the aqueous medium to stabilize the toner particles which are prepared in the aqueous medium. In this case, one or more particulate resins are added in an amount such that the particulate resins are present on the surface of the toner particles at a covering rate of from 10 to 90%. Specific examples of the particulate resins include particulate methyl methacrylate having a particle diameter of 1 μm or 3 μm, particulate polystyrene having a particle diameter of 0.5 μm or 2 μm, particulate styrene-acrylonitrile copolymers having a particle diameter of 1 μm (e.g., PB-200H from Kao Corp., SPG from Soken Chemical & Engineering Co., Ltd., TECHNOPOLYMER SB from Sekisui Plastic Co., Ltd., SGP-3G from Soken Chemical & Engineering Co., Ltd., and MICROPEARL from Sekisui Chemical Co., Ltd.)

In addition, inorganic compounds can be used as a dispersant. Specific examples of the inorganic compounds include tricalcium phosphate, calcium carbonate, titanium oxide, colloidal silica, and hydroxyapatite can be preferably used.

Further, it is preferable to stabilize the emulsion or dispersion using a polymer protection colloid in combination with the particulate resins and inorganic dispersants.

Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g., acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine).

In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protective colloid.

Known dispersing machines can be used for emulsifying the toner composition liquid in an aqueous medium. Suitable dispersing machines include low speed shearing dispersion machines, high speed shearing dispersion machines, friction dispersion machines, high pressure jet dispersion machines, ultrasonic dispersion machines, etc.

When high speed shearing dispersion machines are used, the rotation number of the rotor is not particularly limited, but the rotation number is generally from 1,000 to 30,000 rpm, and preferably from 5,000 to 20,000. The dispersion time is not particularly limited. When a batch dispersion machines are used, the dispersion time is generally from 0.1 to 5 minutes. The dispersion temperature is preferably from 0 to 150° C. and preferably from 40 to 98° C.

(3) Reaction of Polyester Prepolymer (A) with Amine (B)

When the toner composition liquid is added in an aqueous medium to prepare an emulsion, an amine is added to the mixture to react the amine with the polyester prepolymer having an isocyanate group. The reaction is accompanied with crosslinking and/or extension of the molecular chains of the prepolymer. The reaction time is determined depending on the reactivity of the isocyanate group of the polyester prepolymer with the amine used, and is generally from 10 minutes to 40 hours, and preferably from 2 to 24 hours. The reaction temperature is generally from 0 to 150° C., and preferably from 40 to 98° C.

In addition, known catalysts such as dibutyltin laurate and dioctyltin laurate can be used, if desired, for the reaction.

(4) Removal of Organic Solvent and Washing and Drying

After the reaction, the organic solvent is removed from the emulsion (i.e., the reaction product), followed by washing and drying. Thus, toner particles are prepared. In order to remove the organic solvent, the emulsion is gradually heated while the emulsion is agitated so as to have a laminar flow. In this case, it is preferable to remove the solvent in a certain temperature range while strongly agitating the emulsion, so that the resultant toner particles have a spindle form. When a dispersant, which can be dissolved in an acid or an alkali, such as calcium phosphate is used, it is preferable to dissolve the dispersant with hydrochloric acid to remove that from the toner particles, followed by washing. In addition, it is possible to remove such a dispersant by decomposing the dispersant using an enzyme.

(5) Addition of External Additive

Then a charge controlling agent is fixed on the thus prepared toner particles and an external additive such as particulate inorganic materials (e.g., silica and titanium oxide) is added thereto. These materials can be added by a method using a known mixer or the like.

By using such a method, a toner having a small particle diameter and a sharp particle diameter distribution can be easily prepared. By controlling the agitation during the solvent removing operation, the particle form of the toner can be easily changed from spherical forms to rugby-ball forms. In addition, the surface conditions of the toner particles can be controlled so as to have a surface of from smooth surface to rough surface like pickled plum.

The thus prepared toner is used as a one component magnetic developer or a one component nonmagnetic developer or is used for a two component developer including the toner and a carrier.

When the toner is used for a two component developer, the toner is mixed with a carrier such as magnetic materials and glass beads, which preferably have a volume average particle diameter of from 20 to 100 μm. Suitable magnetic materials for use as the carrier include particles of iron, magnetites and ferrites including a divalent metal such as Mn, Zn and Cu. When the volume average particle diameter is too small, a problem in that carrier particles adhere to electrostatic latent images in a developing process occurs. In contrast, when the volume average particle diameter is too large, a problem in that the toner and the carrier are not well mixed, and thereby the toner is insufficiently charged with the carrier occurs, resulting in formation of images with poor image qualities. Among the carriers mentioned above, Cu-ferrites including Zn are preferably used because of having high saturation magnetization. However, a proper carrier is selected therefrom depending on the developing process used for the image forming apparatus for which the resultant developer is used.

The surface of the carrier is preferably coated with a resin. The coating resin is not particularly limited, but resins such as silicone resins, styrene-acrylic resins, fluorine-containing resins, olefin resins, polyester resins, epoxy resins, and maleic acid resins are preferably used. When styrene-acrylic copolymers are used, the content of the styrene unit is preferably from 30 to 90% by weight to impart good developability to the resultant carrier and to prevent occurrence of a problem in that the resin film formed on the carrier is peeled therefrom, resulting in shortening of the life of the carrier. The coating liquid can include additives such as adhesion promoters, crosslinking agents, lubricants, electroconductive agents and charge controlling agents.

The coating method is not particularly limited, but the following methods are preferably used:

(1) a resin solution in which a resin is dissolved in a solvent is sprayed on carrier particles, followed by drying; and (2) a particulate resin is electrostatically adhered to carrier particles, followed by melting of the resin upon application of heat thereto.

The thickness of the coating resin is generally from 0.05 to 10 μm and preferably from 0.3 to 4 μm.

By using a magnetic material in the toner of the present invention, the toner can be used as a magnetic toner. Specific examples of the magnetic materials include iron oxides such as magnetite, hematite, and ferrites; metals such as iron, cobalt, and nickel, and alloys of these metals with a metal such as aluminum, cobalt, copper, lead, magnesium, tin, zinc, antimony, beryllium, bismuth, cadmium, calcium, manganese, selenium, titanium, tungsten, and vanadium. These materials can be used alone or in combination. Among these materials, magnetite is preferably used in view of magnetic properties.

The magnetic materials for use in the toner of the present invention preferably have an average particle diameter of from 0.1 to 2 μm. In addition, the added amount of the magnetic material is generally from 15 to 200 parts by weight, and preferably from 20 to 100 parts by weight, per 100 parts by weight of the resin components included in the toner.

(Image Forming Apparatus)

The image forming apparatus of the present invention will be explained referring to FIG. 3.

Figure 3:
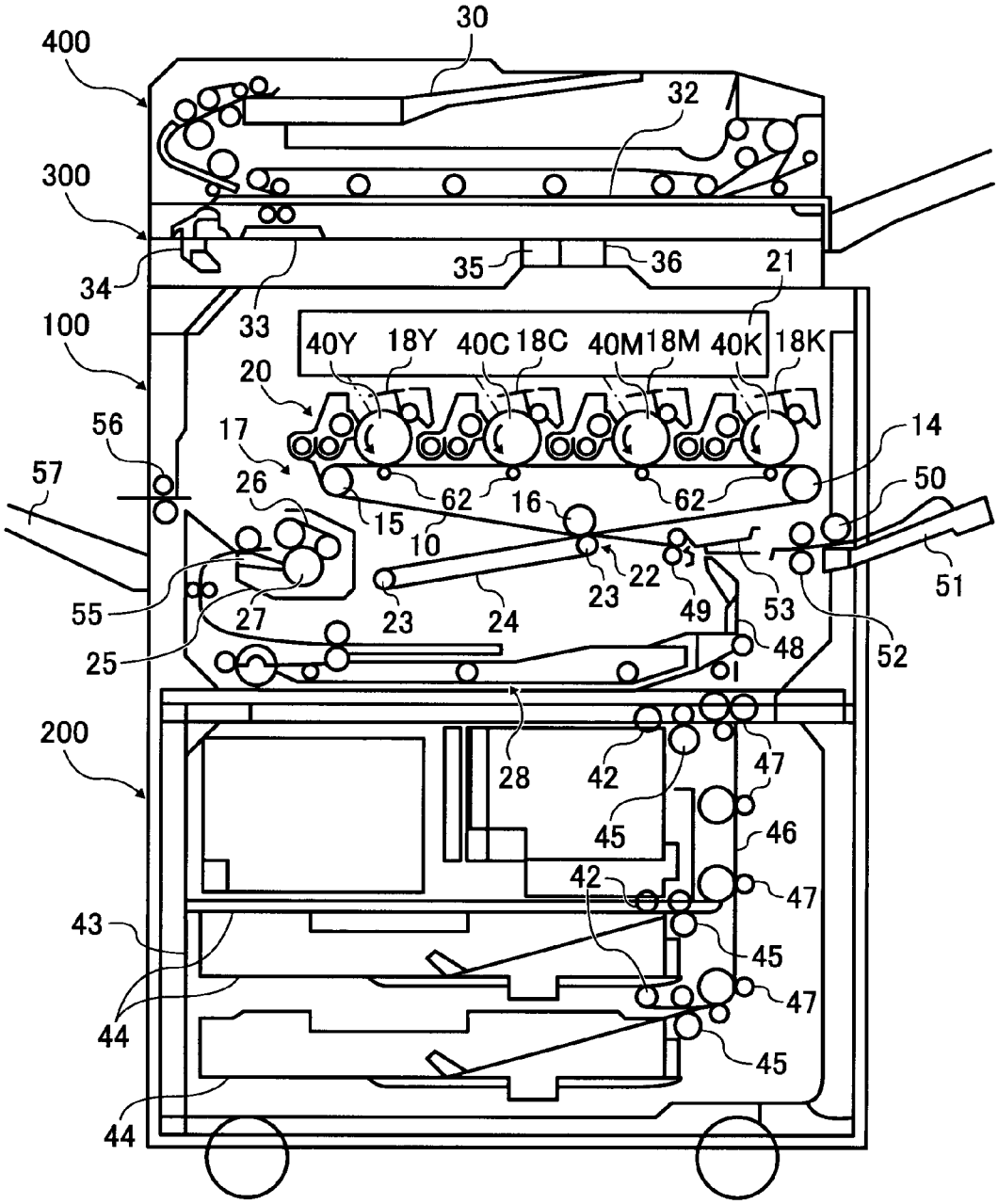
FIG. 3 is a schematic view illustrating an example (a full color image forming apparatus) of the image forming apparatus of the present invention.

FIG. 3 is the overview of an embodiment of the image forming apparatus of the present invention, which is a tandem-type color image forming apparatus. In FIG. 3, the tandem-type color image forming apparatus includes a main body 100 of the image forming apparatus, a paper feeding section 200, a scanner 300 and an automatic document feeder (ADF) 400.

The main body 100 of the image forming apparatus includes a tandem-type image forming section 20 including four image forming units 18 which are arranged side by side to form different color images (such as yellow, magenta, cyan and black toner images) and each of which includes members for performing image forming processes such as charging, developing and cleaning. A light irradiator 21, which irradiates each of photoreceptors 40 serving as an image bearing member with imagewise light to form an electrostatic latent image on the photoreceptor, is arranged at a location over the image forming section 20. An endless intermediate transfer medium 10 is provided so as to face the photoreceptors 40 of the image forming section 20. A primary transfer device 62 (four transfer rollers 62 in FIG. 3) is arranged to transfer color toner images formed on the photoreceptors 40 to the intermediate transfer medium 10.

A secondary transfer device 22 is provided below the intermediate transfer medium 10. The secondary transfer device 22 includes an endless belt 24 which is rotatably stretched by a pair of rollers 23. The endless belt 24 feeds a recording material fed from the feeding table 200 so that the toner images on the intermediate transfer medium 10 are transferred to the recording material, wherein the endless belt 24 is pressed to a support roller 16 with the intermediate transfer medium 10 therebetween.

A fixing device 25 is arranged at a position near the secondary transfer device 22. The fixing device 25 includes an endless fixing belt 26 and a pressing roller 27 which presses the fixing belt 26.

The secondary transfer device 22 also has a sheet feeding function of feeding recording paper sheets to the fixing device 25. It is also possible that the secondary transfer device 22 includes a transfer roller and a non-contact charger. In this case, the second transfer device cannot have a function of feeding recording paper sheets.

In addition, a sheet reversing device 28 configured to reverse the receiving material is provided at a position near the fixing device 25, to produce double-sided copies.

Each image forming unit 18 includes a developing device 4 which contains the toner (developer) mentioned above. The developing device 4 includes a developer bearing member configured to bear and feed the toner to a developing position at which the developer bearing member faces the photoreceptor 40. The developing device 4 develops an electrostatic latent image on the photoreceptor 40 with a developer including the toner mentioned above while applying an alternate voltage. By applying an alternate voltage to the developer, the developer is activated, and thereby the developer has a narrow charge quantity distribution, resulting in improvement of the developability of the developer.

A process cartridge including at least a photoreceptor and a developing device, which are integrated onto a unit and which can be detachably attached to the image forming apparatus, can also be used. The process cartridge can include other devices such as chargers and cleaners. By using such a process cartridge, the maintainability of the image forming apparatus can be improved because the image forming unit 18 can be easily replaced with new one.

Then the full color image forming operation using the tandem-type color image forming apparatus will be explained.

An original to be copied is set on an original table 30 of the automatic document feeder 400. Alternatively, the original is directly set on a glass plate 32 of the scanner 300 after the automatic document feeder 400 is opened, followed by closing of the automatic document feeder 400. When a start button (not shown) is pushed, the color image on the original on the glass plate 32 is scanned with a first traveler 33 and a second traveler 34 which move in the right direction. In the case where the original is set on the table 30 of the automatic document feeder 400, at first the original is fed to the glass plate 32, and then the color image thereon is scanned with the first and second travelers 33 and 34. The first traveler 33 irradiates the color image on the original with light and the second traveler 34 reflects the light reflected from the color image to send the color image light to a sensor 36 via a focusing lens 35. Thus, color image information (i.e., black, yellow, magenta and cyan color image data) of the original is read.

The black, yellow, magenta and cyan color image data are sent to the respective black, yellow, magenta and cyan color image forming units 18, and black, yellow, magenta and cyan color toner images are formed on the respective photoreceptors 40 by performing the charging, light irradiating and developing processes. Each of the image forming units 18 includes a charger configured to charge the image bearing member 40, the developing device 4, an image bearing member's cleaning device configured to clean the surface of the image bearing member.

The thus prepared black, yellow, magenta and cyan color toner images are transferred one by one to the intermediate transfer medium 10 which is rotated by rollers 14, 15 and 16, one of which is a driving roller and the other of which are driven rollers, resulting in formation of a full color toner image on the intermediate transfer medium 10.

On the other hand, one of paper feeding rollers 42 is selectively rotated to feed the uppermost paper sheet of paper sheets stacked in a paper cassette 44 in a paper bank 43 while the paper sheet is separated one by one by a separation roller 45 when plural paper sheets are continuously fed. The paper sheet is fed to a passage 48 in the main body 100 through a passage 46 in the paper feeding section 200, and is stopped once by a pair of registration rollers 49. Numeral 47 denotes feed rollers. A paper sheet can also be fed from a manual paper tray 51 to a passage 53 by a feed roller 50 and a pair of separation rollers 52. The thus fed paper sheet is also stopped once by the registration roller 49. The registration rollers 49 are generally grounded, but a bias can be applied thereto to remove paper dust therefrom.

The thus prepared full color toner image on the intermediate transfer medium 10 is transferred to the paper sheet, which is timely fed by the registration roller 49, at the contact point of the secondary transfer device 22 and the intermediate transfer medium 10. Toner particles remaining on the surface of the intermediate transfer medium 10 even after the secondary image transfer operation are removed therefrom by the cleaner 17.

The paper sheet having the full color toner image thereon is then fed by the second transfer device 22 to the fixing device 25, and the toner image is fixed on the paper sheet upon application of heat and pressure in the fixing device 25. Then the paper sheet is discharged from the main body 100 by a pair of discharge rollers 56 while the path is properly selected by a paper path changing pick 55. Thus, a copy is stacked on a tray 57.

When a double sided copy is produced, the paper sheet having a toner image on one side thereof is fed to the sheet reversing device 28 to be reversed. Then the paper sheet is fed to the second transfer device 24 so that an image is transferred to the other side of the paper sheet. The image is also fixed by the fixing device 25 and then the copy is discharged to the tray 57 by the discharge roller 56.

The image forming apparatus of the present invention can be preferably used as a color image forming apparatus, but can be used as a monochrome image forming apparatus.

(Fixing Device)

Figure 4A:
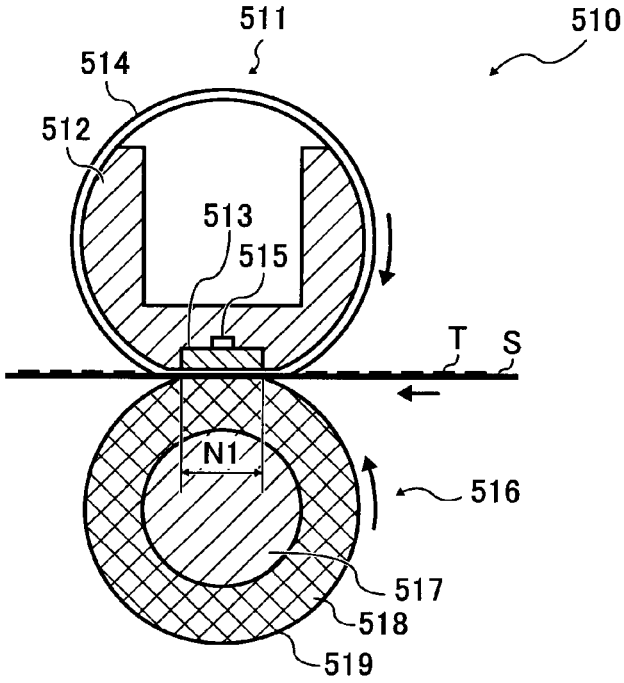
FIGS. 4 and 5 are schematic views illustrating fixing devices for use in the image forming apparatus of the present invention.
Figure 4B:
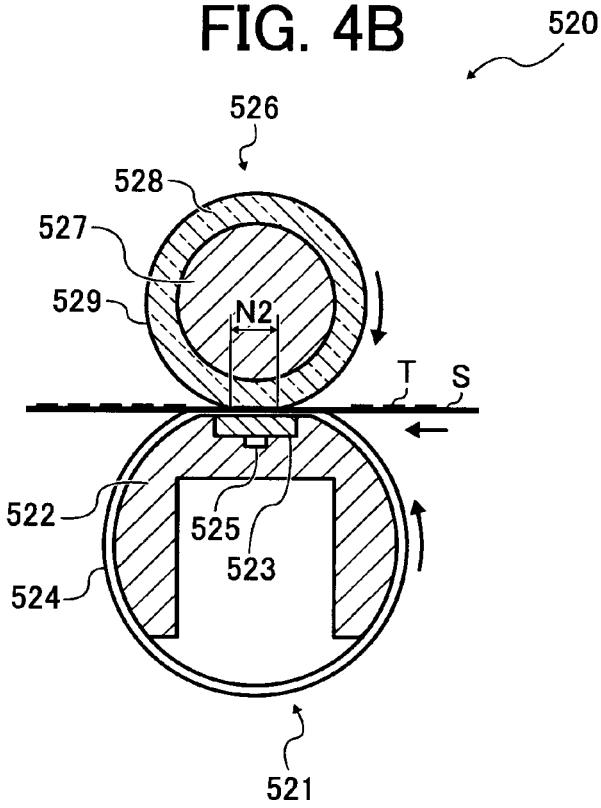

A fixing device for use in the image forming apparatus of the present invention will be explained by reference to FIGS. 4A and 4B. FIGS. 4A and 4B are enlarged cross sectional views of fixing devices 510 and 520. Each of the first fixing device 510 and the second fixing device 520 is a heat film fixing unit using a ceramic heater as a heating element.

At first, the first fixing device will be explained. The first fixing device 510 includes a first heater unit 511, which serves as a first heating member, and a first pressure roller 516, which serves as a first pressure member and which is located below the first heater unit 511.

The first heater unit 511 includes a film guide 512 having a diameter of about 24 mm, a ceramic heater 513 which serves as a heating element and which is provided on the film guide 512; a cylindrical (i.e., endless) heat resistant film 514, which is loosely wound around the peripheral surface of the combination of the film guide 512 and the ceramic heater 513; a thermistor 515 for controlling the temperature of the ceramic heater 513; etc. The ceramic heater 513 faces downward, and is located above the receiving sheet S.

The ceramic heater 513 includes a substrate made of a ceramic such as alumina, an electroconductive heat generation layer formed on one side of the substrate, the thermistor 515 which is configured to control the temperature of the ceramic heater and which is provided on the other side of the substrate, and an insulating layer made of a heat resistant glass which covers the thermistor. The temperature of the heater unit is controlled depending on the temperature detected by the thermistor.

The film 514 is a thin film of a heat resistant material such as polyimide resins, on the surface of which a release layer made of a release material such as fluorine-containing resins is formed to prevent adhesion of toner particles to the film 514.

The pressure roller 516 is a roller having a diameter of about 20 mm including a core 517 having a diameter of about 13 mm, which is made of a metal such as aluminum; an elastic layer 518 having a thickness of about 3.5 mm, which is made of a material such as silicone rubbers; and a release layer 519 which is made of a thin film of a release material such as PFA which is located on the elastic layer. Both ends of the core 517 are rotatably supported.

Since the first heater unit 511 is pressure-contacted with the pressure roller 516 by a pressing device (not shown), the elastic layer 518 of the pressure roller 516 is deformed, thereby forming a nip N1 between the film 514 (ceramic heater) and the pressure roller 516.

Since the pressure roller 516 is counterclockwise rotated by a driving device (not shown) as illustrated by an arrow in FIG. 4, the film 514 is clockwise rotated while driven by the pressure roller 516 in such a manner that the inner surface of the film 514 is contacted with the ceramic heater 513 and the peripheral surface of the film guide 512.

Next, the second fixing device 520 will be explained. The second fixing device 520 has a structure such that the first fixing device is vertically reversed, i.e., a structure such that a pressure roller is located above a heater unit. Specifically, the second fixing device 520 includes a second heater unit 521 serving as a heating member, which is similar to the first heater unit 511 and which includes a film guide 522, a ceramic heater 523 serving as a heating element, a film 524 and a thermistor 525. The ceramic heater 523 faces upward, and is located below the receiving sheet S.

The second pressure roller 526 is a roller having a diameter of about 16 mm including a core 527 having a diameter of about 13 mm, which is made of a metal such as aluminum; an elastic layer 528 having a thickness of about 1.5 mm, which is made of a material such as silicone rubbers; and a release layer 529 which is made of a thin film of a release material such as PFA and which is located on the elastic layer. Both ends of the core 527 are rotatably supported.

Since the second heater unit 521 is pressure-contacted with the pressure roller 526 by a pressing device (not shown), the elastic layer 528 of the pressure roller 526 is deformed, thereby forming a nip N2 between the film 524 (ceramic heater) and the pressure roller 526.

Since the pressure roller 526 is clockwise rotated by a driving device (not shown) as illustrated by an arrow in FIG. 4, the film 524 is counterclockwise rotated while driven by the pressure roller 526 in such a manner that the inner surface of the film 524 is contacted with the ceramic heater 523 and the peripheral surface of the film guide 522.

Since the second pressure roller 526 has a diameter smaller than that of the first pressure roller 516, and the elastic layer 528 is thinner than the elastic layer 518, the width of the second nip N2 is shorter than that of the first nip N1. Since the total pressure applied to the second fixing device 520 is the same as that for the first fixing device 510, the pressure (linear pressure) per a unit nip width at the second nip N2 is higher than that at the first nip N1.

The fixing devices 510 and 520 do not perform a preliminary heating (i.e., a preliminary energization operation, etc.) in a waiting time. When a print order is made and a print signal is received, the first and second pressure rollers 516 and 526 start to rotate in the respective directions while the ceramic heaters 513 and 523 are energized. Thus, the surfaces of the first and second pressure rollers 516 and 526 are rapidly heated to the predetermined temperatures at the nips N1 and N2 by the ceramic heaters 513 and 523 through the films 514 and 524.

It is preferable to use a fixing device in which the first fixing device 510 and the second fixing device 520 are serially arranged.

In this fixing device, the receiving sheet S, which is fed to the fixing device 510, is subjected to a first fixing treatment at the first nip N1, in which the front side of the sheet S bearing a toner image is heated by the film 514 and the backside of the sheet S is heated by the pressure roller 516, while fed by the film and the pressure roller.

Then the receiving sheet S is subjected to a second fixing treatment at the second nip N2, in which the front side of the sheet S bearing a toner image is heated by the pressure roller 526 and the backside of the sheet S is heated by the film 524, while fed by the film and the pressure roller. Thus, the toner image is fixed on the receiving sheet S.

The merit of pressing the film 514 toward the toner image T on the sheet S at the first nip N1 is that the toner image directly receives heat from the ceramic heater 513 through the film 514. Namely, the fixing method has an extremely high heat efficiency.

However, when the toner image T includes plural color images, the toner image has uneven surface (namely, the toner image has uneven glossiness) after the first fixing treatment. This is because although the plural color toner images are fixed on the sheet S while mixed, the surface of the toner image is not well smoothed by the film 514 having no elastic layer.

The toner image T thus subjected to the first fixing treatment is then subjected to a second fixing treatment at the second nip N2, in which the toner image is heated by the second pressure roller 526 and the back side is heated by the film 524. Therefore, the toner image T is pressed at a higher linear pressure by the pressure roller 526 while wrapped by the pressure roller, and thereby the surface of the toner image is smoothed, resulting in formation of a fixed toner image having even glossiness.

The receiving sheet S bearing a fixed toner image is then fed to the discharge tray 57 (FIG. 3) by an exit guide and a discharging roller (not shown) via the paper discharging portion.

When the receiving sheet S is a plain paper having a medium thickness, the first fixing device 510 fixes the toner image T and the second fixing device 520 smoothes the surface of the toner image. However, when the receiving sheet S is a thick paper, the first fixing unit 510 incompletely fixes the toner image because the sheet S has a large heat capacity. Even in this case, the second fixing unit 520 completely fixes the toner image while smoothing the surface of the toner image. Therefore the resultant toner image has a good combination of fixing property and glossiness.

When the receiving sheet S is an overhead projection sheet, it is preferable that the fixed color toner image has high transparency to project a beautiful color image. Even in this case, by fixing the toner image with the second fixing unit (i.e., the second pressure roller having an elastic layer) at a high linear pressure, high transparency can be imparted to the resultant fixed toner image.

The linear pressure at the nip N2 can be adjusted by changing the diameter of the second pressure roller 526, the thickness and hardness of the elastic layer 528, the pressure applied to the pressure roller, etc.

Figure 5A:
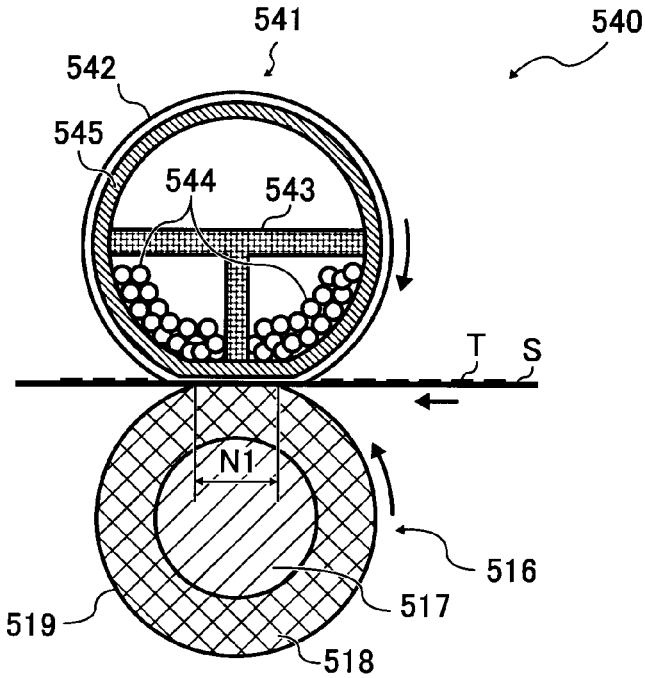
Figure 5B:
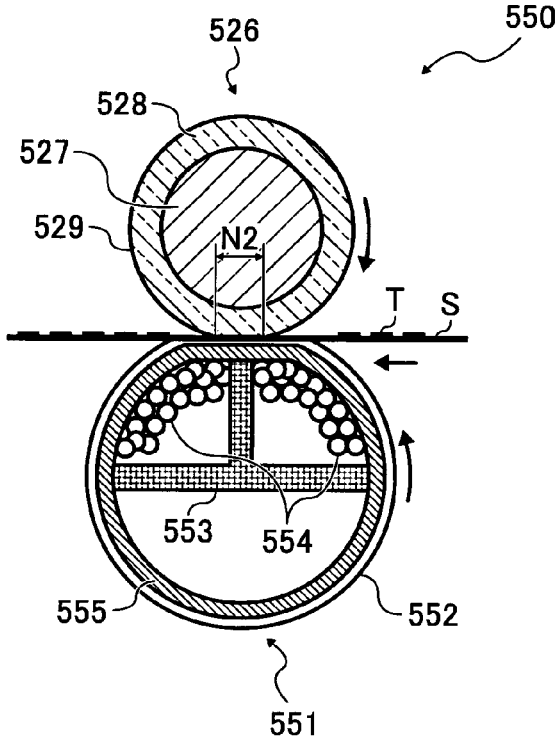

Other fixing devices for use in the image forming apparatus of the present invention will be explained by reference to FIGS. 5A and 5B. FIGS. 5A and 5B are enlarged cross sectional views illustrating a third fixing device 540 and a fourth fixing device 550. Each of the third fixing device 540 and the fourth fixing device 550 is a film fixing unit using an electromagnetic induction heating method.

At first, the third fixing device 540 will be explained. The third fixing device 540 includes a third heater unit 541 and the first pressure roller 516.

The third heater unit 541 includes a sleeve guide 545; a combination of a magnetic core 543 and an exciting coil 544, which serves as magnetic field generating means and which is arranged in the sleeve guide 545; a cylindrical sleeve 542 made of a heat resistant film, which serves as an electromagnetic induction heating element and which is loosely set on the peripheral surface of the sleeve guide 545; etc.

The sleeve 542 includes an electromagnetic induction heating layer, which is a basic layer and which is made of a cylindrical thin ferromagnetic metal layer having a release layer thereon which is made of a release agent such as PFA.

The magnetic core 543 has a T-form cross section and is made of a material having a high magnetic permeability such as ferrites and permalloys for use in cores of transformers.

The exciting coil 544 is made of plural copper wires, on each of which an insulating layer is formed and which are bundled, and is wound around the magnetic core 543 plural times. An exciting circuit (not shown) which can generate a radio-frequency wave of from 20 kHz to 500 kHz using a switching power source is connected with the exciting coil 544, and therefore the exciting coil 544 generates an alternating magnetic flux by the alternating current (radio-frequency wave current) supplied from the exciting circuit.

The pressure roller 516 is the same as the first pressure roller 516 used for the first fixing device 510, and therefore the explanation is omitted.

The third heater unit 541 has a structure such that the sleeve guide 545 is located above the pressure roller 516 while a flat portion of the sleeve guide 545 faces the pressure roller 516. Since a predetermined pressure is applied to the pressure roller 516 by pressing means (not shown), a nip N3 is formed between the flat portion of the sleeve guide and the pressure roller 516.

Since the pressure roller 516 is counterclockwise rotated by driving means (not shown), the sleeve 542 is clockwise rotated while driven by the pressure roller 516 in such a manner that the inner surface of the sleeve is contacted with the flat portion of the sleeve guide 545.

The alternating magnetic flux generated by applying an alternating current to the exciting coil 544 is guided to the magnetic core 543, and thereby an eddy current is generated in the electromagnetic heat generation layer of the sleeve 542 mainly at the nip N3. In this case, Joule heat is generated in the heat generation layer due to the eddy current and the resistance of the heat generation layer, and thereby the temperature of the sleeve 542 is raised. The temperature of the sleeve 542 is controlled by changing the current in the exciting coil 544 on the basis of the temperature of the sleeve detected by a temperature detection device (not shown).

Next, the fourth fixing device 550 will be explained. The fourth fixing device 550 has a structure such that the third fixing unit is vertically reversed, i.e., a structure such that a pressure roller is located above a heater unit. Specifically, the fourth fixing device 550 includes a fourth heater unit 551 serving as a heating member, which is similar to the third heating unit 540 and which includes a sleeve guide 555, a combination of a magnetic core 553 and an exciting coil 554 serving as magnetic field generation means, a cylindrical sleeve 552, which is loosely wound around the peripheral surface of the sleeve guide 555 and which serves as an electromagnetic induction heating element, etc. The flat portion of the sleeve guide 555 faces upward, and is located below the receiving sheet S.

The pressure roller 526 of the fourth fixing device 550 is the same as the pressure roller 526 of the second fixing device 520, and therefore the explanation thereof is omitted.

Both ends of the core 527 of the pressure roller 526 are rotatably supported. Since the pressure roller 526 is pressure-contacted with the flat portion of the fourth heater unit 551 by a pressing device (not shown) with the sleeve 554 therebetween, the elastic layer 528 of the pressure roller 526 is deformed, thereby forming a nip N4 between the sleeve 552 (the flat portion of the sleeve guide) and the pressure roller 526.

Since the pressure roller 526 is clockwise rotated by a driving device (not shown) as illustrated by an arrow in FIG. 5, the sleeve 552 is counterclockwise rotated while driven by the pressure roller 526 in such a manner that the inner surface of the sleeve 552 is contacted with the flat portion of the sleeve guide 555 and the peripheral surface of the sleeve guide 555.

It is preferable to use a fixing device in which the third and fourth fixing devices are serially arranged side by side.

In this fixing device, the receiving sheet S, which is fed to the fixing device 530, is subjected to a first fixing treatment at the first nip N3, in which the front side of the sheet S bearing a toner image is heated by the sleeve 542 and the backside of the sheet S is heated by the pressure roller 516, while fed by the sleeve and the pressure roller. Then the receiving sheet S is subjected to a second fixing treatment at the second nip N4, in which the front side of the sheet S bearing a toner image is heated by the pressure roller 526 and the backside of the sheet S is heated by the sleeve 524, while fed by the sleeve and the pressure roller. Thus, the toner image is fixed on the receiving sheet S.

By using such a combination fixing device, the resultant fixed images have good fixing property.

The fixing devices 540 and 550, which use electromagnetic induction heating, have an advantage over the fixing devices 510 and 520 using a ceramic heater such that a larger amount of heat is rapidly applied to the pressure rollers 516 and 526 and the sheet S. Therefore, the fixing devices 540 and 550 are preferably used for higher speed image forming apparatuses.

As mentioned above, in the combination fixing devices (510-520 and 540-550) the toner image T on the sheet S is efficiently fixed by the first or third fixing device, and then the toner image is further fixed and smoothed by the second or fourth fixing device. Therefore, the fixing devices can be used for high speed image forming apparatuses, and can produce color images having high glossiness and transparency. In addition, since a thin film or sleeve, which has a low heat capacity, is used for the heater units 511, 521, 541 and 551, the warm-up time can be shortened and in addition power consumption of the fixing device can be reduced because it is not necessary to perform preliminary heating.

Further, since similar heater units are used for the heater units 511 and 521 (or 541 and 551), the same parts and heater controlling method can be used, resulting in reduction of the manufacturing costs.

It is possible that the ceramic heaters 513 and 523 of the first and second heater units are replaced with an electromagnetic induction heating member such as that used for the third and fourth heater units 541 and 551. In addition, it is possible that heater units of different types are used for the first and second (or third and fourth) heater units (for example, combinations of a heater unit having a ceramic heater and another heater having an electromagnetic induction heater).

(Toner Preparation Method)

Toner particles of the toner for use in the present invention are prepared by discharging a toner composition liquid including at least a colorant and a binder resin from nozzles, which are vibrated at a predetermined frequency to form droplets, followed by drying the liquid droplets.

The device (hereinafter referred to as toner preparation device) for preparing the toner for use in the present invention will be explained.

The toner preparation device is not particularly limited as long as the device can produce the toner using the toner preparation method mentioned above. However, it is preferable to use a toner preparation device including at least a liquid droplet forming device configured to form droplets of a toner composition liquid (solution or dispersion) including at least a colorant and a binder resin by ejecting the toner composition liquid from a nozzle; and a toner particle forming device configured to dry the droplets of the toner composition liquid to prepare toner particles. It is more preferable that the liquid droplet forming device includes a vibrator configured to directly vibrate the nozzle when the toner composition liquid passes through the nozzle, and the toner preparation device further includes a storage device configured to store the toner composition liquid.

Figure 6:
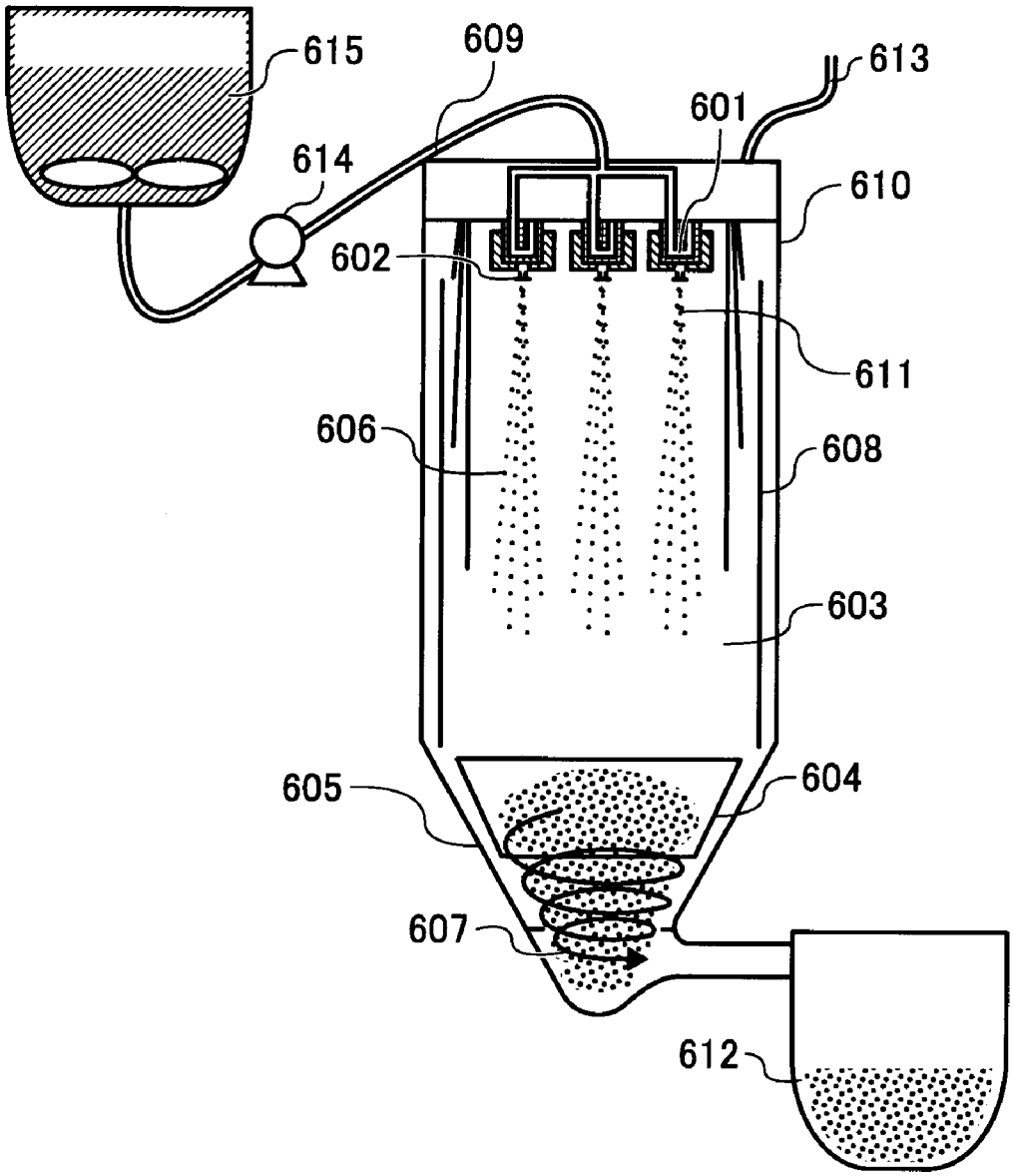
FIG. 6 is a schematic view illustrating a toner preparation apparatus for use in preparing the toner for use in the image forming apparatus of the present invention.

A preferable example of the toner preparation device is illustrated in FIG. 6. Referring to FIG. 6, the toner preparation device includes a slurry storage container 615 serving as the storage device; a solvent removing device 603, a discharger 604 and a toner collecting portion 605 which are provided in a drying vessel 610 and which serve as the toner particle forming device; nozzle 601 and electrodes 602, which are provided in the drying vessel 610 and which serve as the liquid droplet forming device; and a piezoelectric material 621 (illustrated in FIG. 7) serving as the vibrator.

In the toner preparation device illustrated in FIG. 6, the toner composition liquid stored in the slurry storage container 615 is fed to the nozzle 601 by a constant rate pump 614 through a tube 609 while controlling the amount of the fed toner composition liquid. The toner composition liquid is ejected from the nozzle 601 to form liquid droplets 611. After the droplets 611 are charged by the electrodes 602, the solvent is removed from the droplets by the solvent removing device 603, resulting in formation of toner particles 606. After being discharged by the discharger 604, the toner particles are collected in a collecting portion 605 and are then fed to a toner storage 612.

Next, the devices of the toner preparation device will be explained in detail.

The nozzle 601 ejects the toner composition liquid to form droplets thereof. The material and form of the nozzles are not particularly limited. However, a nozzle in which one or more openings having an inside diameter of from 3 to 35 μm are formed on a metal plate with a thickness of from 5 to 50 μm is preferably used. By vibrating such a nozzle to apply a shear force to the toner composition liquid, droplets having a sharp particle diameter distribution can be discharged from the nozzle. In this regard, the inside diameter of the nozzles means the diameter of a circle when the nozzle have a perfect circular cross section, and means the minor axis diameter when the nozzle has an elliptical cross section.

Figure 7:
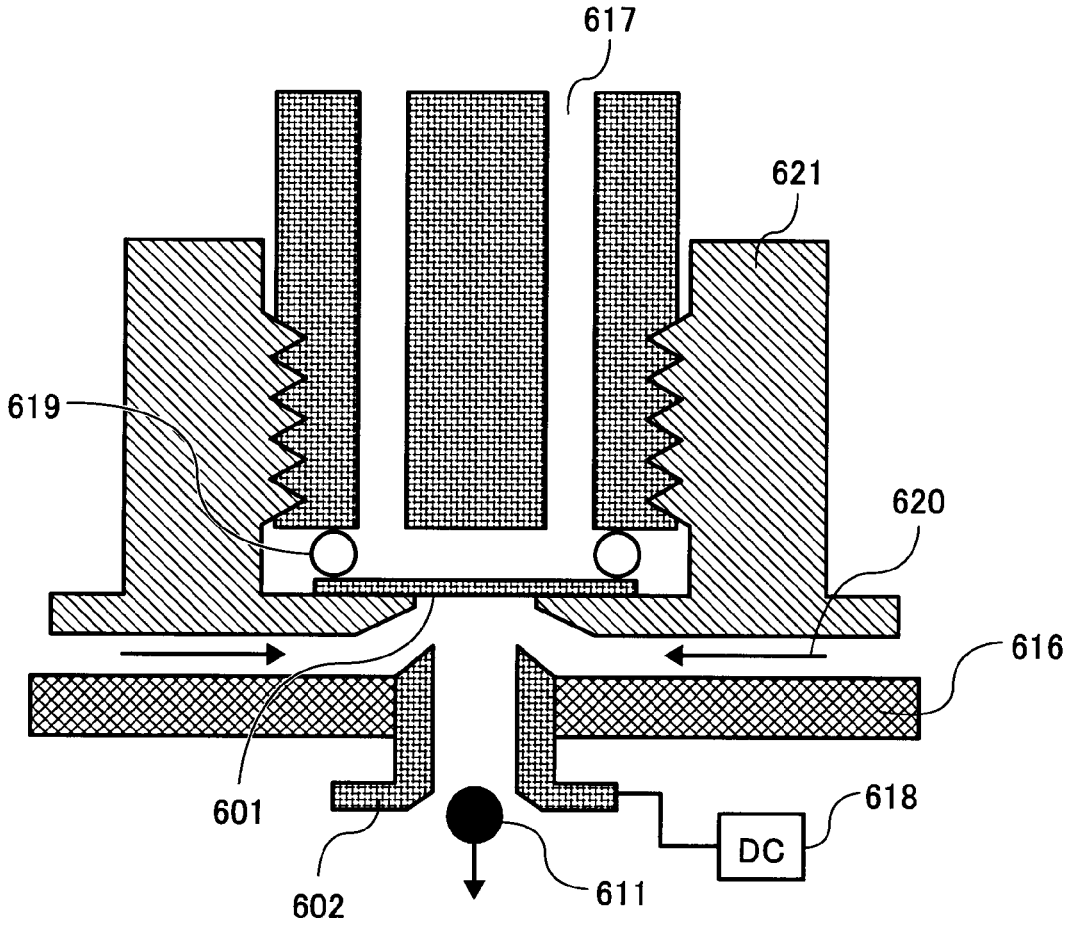
FIG. 7 is an enlarged view illustrating the nozzle of the toner preparation apparatus illustrated in FIG. 7.

Known vibrators can be used for the vibrator for vibrating the nozzle 601 as long as the vibrators vibrate the nozzle at a predetermined frequency. Among the vibrators, a vibrator vibrating the nozzle 601 at a predetermined frequency by expansion and contraction of the piezoelectric material 621 as illustrated in FIG. 7 is preferably used. The piezoelectric material 621 has a function of converting an electric energy to a mechanical energy. Specifically, by applying a voltage to the piezoelectric material 621, the material 621 is expanded and contracted, thereby vibrating the nozzle 601.

Specific examples of the piezoelectric substances for use in the piezoelectric material 621 include piezoelectric ceramics such as lead titanate zirconate (PZT). However, since piezoelectric ceramics have small amount of displacement, laminated bodies in which plural piezoelectric layers are laminated are typically used. In addition, piezoelectric polymers such as polyvinylidene fluoride (PVDF), and piezoelectric single crystals such as quartz, $LiNbO_3$, and $LiTaO_3$, $KnbO_3$ can also be used.

The frequency at which the vibrator vibrates the nozzle 601 is not particularly limited, but is preferably from 50 kHz to 50 MHz, more preferably from 100 kHz to 10 MHz, and even more preferably from 100 kHz to 450 kHz.

The number of the nozzle is not particularly limited and one or more nozzles can be used. However, it is preferable in view of efficiency to eject the toner composition liquid from plural nozzles and dry the droplets in a single solvent removing device (e.g., the solvent removing device 603). In addition, it is also preferable to vibrate the plural nozzles by respective vibrators.

As illustrated in FIG. 7, at least parts of the piezoelectric material 621 and the nozzle 601 are contacted with each other. When the piezoelectric material 621 is expanded and contracted, the nozzle is vibrated, thereby ejecting a droplet of the toner composition liquid. In this regard, the nozzle 601 can have a structure in which plural openings are formed on a metal plate. In this case, by vibrating the piezoelectric material 621, plural droplets can be discharged from the nozzle 601. The droplets ejected from such a nozzle have a shaper particle diameter distribution than that in a case where vibration of the piezoelectric material is applied to the nozzle via another material such as liquid contained in a liquid room. This is because in that case the vibration transmission speed changes depending on the distance between the piezoelectric material and the nozzle. Therefore, in the case where one vibrator vibrates plural nozzles via a liquid in an ink room, time-lag occurs in discharging of droplets from the plural nozzles, the amounts of droplets ejected from the plural nozzles are different. When one vibrator vibrates one nozzle via a liquid in an ink room, the variation of the particle diameter of the ejected droplets can be reduced but the production efficiency decreases or the costs of the toner preparation device increase.

Referring to FIG. 7, the nozzle 601 further includes an insulating plate 616, a liquid feeding passage 617, a high DC voltage power supply 618, a no-ring 619, and air 620 for dispersing the liquid droplets. When the piezoelectric material 621 is expanded and contracted while contacted with the nozzle 601, the toner composition liquid which is fed through the liquid feeding passage 617 is changed to droplets and the droplets are fed by air 620 to the electrode 602 to which a DC voltage is applied by the high DC voltage power supply 618. In this regard, since the insulating plate 616 is provided, the DC voltage is not applied to a member other than the electrode 602.

The total number of ejection openings of the nozzle 601 which are vibrated by one piezoelectric material is not particularly limited. However, in order to eject droplets having a sharp particle diameter distribution, the total number of the ejection openings is preferably from 1 to 300. In this regard, the number of the nozzle 1 is preferably from 1 to 15, and the number of ejection openings in one nozzle is preferably from 1 to 20.

The electrode 602 is a member for charging the droplets ejected from the nozzle 601 to form monodisperse particles. The electrode 602 is a pair of members, which oppose the nozzle 601. The shape of the electrode is not particularly limited, but it is preferable for the electrode to have a ring shape as illustrated in FIG. 7. The method for charging the droplets is not particularly limited. For example, it is preferable to form a positive or negative charge in the droplets using induction charging. Specifically, it is preferable to apply a DC voltage to the droplets when the droplets pass through the ring-form electrode 602 to perform induction charging. Alternatively, it is possible to charge the droplets by directly applying a DC voltage to the nozzle 601 while grounding the bottom of the drying vessel 610. In this regard, the voltage can be applied via the toner composition liquid (which is electroconductive) contained in the slurry storage container 615. By electrically insulating the toner composition liquid by feeding the liquid to the slurry storage container 615 utilizing air pressure, induction charging can be easily performed. It is already verified from formation of particles using electro spray methods and electrostatic spray methods that a droplet in an airflow has a highly charged state. In this case, it is possible to impart a larger amount of charge to the resultant toner particles than in a case where a charge is imparted to solid toner particles because the droplet has a larger volume than the solid toner particle. Therefore, the droplet can have a larger amount of charge, and the larger amount of charge remains in the resultant solid toner particle.

The solvent removing device 603 is not particularly limited as long as the device has a function of removing the solvent included in the droplets 611. However, it is preferable to use a device in which a dry gas (having a dew point of not higher than −10° C. at atmospheric pressure) is flown in the same direction as the ejecting direction of the droplets to generate a stream. In this regard, the droplets are fed in the drying vessel 610 by the stream and the solvent in the droplets is dried by the stream, resulting in formation of the toner particles 606. Specific examples of the gasses for use as the dry gas include air, nitrogen gas, etc.

The method for flowing a dry gas is not particularly limited, and, for example, a method using a tube 613 for feeding a dry gas can be used.

With respect to the temperature of the dry gas, the higher the better in view of drying efficiency. Even when the temperature of the gas is higher than the boiling point of the solvent included in the droplets, the temperature of the droplets never reach a temperature higher than the boiling point of the solvent in a constant-drying-rate period, and thereby the resultant toner particles are not thermally damaged. However, in the falling-drying-rate period after the end of drying, it is preferable that the temperature of the dry gas is lower than the melting point of the binder resin included in the toner particles to prevent occurrence of a problem in that toner particles fuse with each other, resulting in loss of monodisperse property of the toner particles. Therefore, the temperature of the dry gas is preferably from 40 to 200° C., more preferably from 60 to 150° C., and even more preferably from 75 to 85° C.

An electric field curtain 608 having a charge with a polarity opposite to that of the charge of the droplets is preferably formed near the inner surface of the solvent removing device 603 to prevent the droplets 611 from adhering to the inner surface. In this case, the droplets pass through the passage surrounded by the electric field curtain 608.

The discharger 604 discharges the charged toner particles so that toner particles 607 are contained in a toner collection section 605. The discharging method is not particularly limited, but it is preferable to use a method using soft X-ray irradiation or plasma irradiation in view of discharging efficiency.

The toner collection section 605 is provided on a bottom of the toner preparation device to efficiently collect and feed the toner particles. The structure of the toner collection section 605 is not particularly limited as long as the toner collection section can collect the toner particles. However, the toner collection section preferably has the structure as illustrated in FIG. 6 in that the cross section is gradually decreased in the direction of from the entrance to the exit thereof such that the toner particles 607 are fed to the toner storage container 612 along the stream of the dry gas. In order to feed the toner particles to the toner storage container 612, a method in which a pressure is applied to the toner particles 607 or a method in which the toner particles 607 are sucked from the side of the toner storage container 612 can be used.

When the toner particles are fed to the toner storage container 612, the toner particles are preferably swirled as illustrated in FIG. 6 such that a centrifugal force is applied thereto, resulting in secure transportation of the toner particles. In addition, in order to efficiently transport the toner particles 607 to the toner storage container 612, the toner storage container is preferably made of an electroconductive material while being grounded. In addition, the toner preparation device is preferably an explosion-proof device.

As mentioned above, the droplets 611 are formed by ejecting the toner composition liquid from the nozzle 601, which is vibrated at a predetermined frequency. The toner constituents included in the toner composition liquid are explained above.

The toner composition liquid is not particularly limited as long as the liquid is prepared by dissolving or dispersing toner constituents in a solvent. However, in order to impart a large amount of charges to the toner composition liquid, the liquid preferably has an electrolytic conductivity of not less than $1.0\times10^{-7}$ S/m. In addition, the solvent used for the toner composition liquid preferably has an electrolytic conductivity of not less than $1.0\times10^{-7}$ S/m.

The method for preparing the toner composition liquid (i.e., dissolving or dispersing toner constituents in a solvent) is not particularly limited, and known methods can be used. For example, the following method can be used.

(1) A binder resin (such as styrene-acrylic resins, polyester resins, polyol resins, and epoxy resins) is kneaded together with other components such as colorants upon application of heat thereto;

(2) the kneaded mixture is pulverized; and (3) the pulverized mixture is dispersed in a solvent.

Alternatively, the kneaded mixture can be dissolved in a solvent capable of dissolving the binder resin.

The particle diameter of the toner particles prepared by drying the droplets of the toner composition liquid can be determined by the following equation (1).

$$Dp=(6QC/\pi f)^{1/3} \quad (1)$$

wherein Dp represents the particle diameter of the resultant dry toner particles; Q represents the flow rate of the toner composition liquid, which depends on the flow rate of the pump used and the diameter of the nozzle; f represents the vibration frequency; and C represents the volume concentration of the solid components in the toner composition liquid.

The particle diameter of the toner particles can be easily calculated using the following equation (2).

$$C=(Dp/Lp)^3 \quad (2)$$

wherein Lp represents the particle diameter of the droplets of the toner composition liquid.

Specifically, the particle diameter (Lp) of the droplets ejected from the nozzle is twice the diameter of the opening of the nozzle and is not influenced by the vibration frequency. Since the volume concentration (C) of the solid components in the toner composition liquid is known, the particle diameter (Dp) of the dry toner particles which are prepared by drying the droplets can be determined by equation (2). For example, when the diameter of the opening of the nozzle is 7.5 μm, the particle diameter (Lp) of the droplets ejected from the nozzle (opening) is 15 μm. If the volume concentration (C) of the solid components in the toner composition liquid is 6.0% by volume, the particle diameter of the resultant solid toner particles is 6.0 μm. With respect to the vibration frequency, the higher the better in view of productivity of the toner particles. When the vibration frequency is determined, the flow rate Q of the toner composition liquid can be determined.

In conventional toner preparation methods, the particle diameter of the resultant toner particles largely changes depending on the variables such as choice of the materials used for the toner particles. However, by using the method of the present invention while controlling the particle diameter of the droplets and concentration of the solid components of the toner composition liquid, toner particles having a target particle diameter can be continuously produced.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Preparation Example 1

(Synthesis of Particulate Organic Material Emulsion)

In a reaction vessel equipped with a stirrer and a thermometer, 683 parts of water, 11 parts of a sodium salt of sulfate of an ethylene oxide adduct of methacrylic acid (ELEMINOL RS-30 from Sanyo Chemical Industries Ltd.), 138 parts of styrene, 138 parts of methacrylic acid, and 1 part of ammonium persulfate were mixed. The mixture was agitated for 15 minutes while the stirrer was rotated at a revolution of 400 rpm. As a result, a milky emulsion was prepared. Then the emulsion was heated to 75° C. to react the monomers for 5 hours.

Further, 30 parts of a 1% aqueous solution of ammonium persulfate were added thereto, and the mixture was aged for 5 hours at 75° C. Thus, an aqueous dispersion (hereinafter referred to as particulate resin dispersion (1)) of a vinyl resin (i.e., a copolymer of styrene/methacrylic acid/sodium salt of sulfate of ethylene oxide adduct of methacrylic acid) was prepared.

The volume average particle diameter of the particles in the particulate resin dispersion (1), which was measured with an instrument LA-920 from Horiba Ltd., was 0.14 μm. In addition, part of the particulate resin dispersion (1) was dried to prepare a solid of the vinyl resin. It was confirmed that the vinyl resin has a glass transition temperature (Tg) of 152° C.

Preparation Example 2

(Preparation of Aqueous Phase Liquid)

In a reaction vessel equipped with a stirrer, 990 parts of water, 125 parts of the particulate resin dispersion 1 prepared above, 37 parts of an aqueous solution of a sodium salt of dodecyldiphenylether disulfonic acid (ELEMINOL MON-7 from Sanyo Chemical Industries Ltd., solid content of 48.5%), and 90 parts of ethyl acetate were mixed while agitated. As a result, a milky liquid (hereinafter referred to as an aqueous phase liquid 1) was prepared.

Preparation Example 3

(Preparation of Low Molecular Weight Polyester Resin)

The following components were contained in a reaction vessel equipped with a condenser, a stirrer and a nitrogen feed pipe to perform a polycondensation reaction for 8 hours at 230° C. under normal pressure.

| | |
|---|---|
| Ethylene oxide (2 mole) adduct of bisphenol A | 229 parts |
| Propylene oxide (3 mole) adduct of bisphenol A | 529 parts |
| Terephthalic acid | 208 parts |
| Adipic acid | 46 parts |
| Dibutyltin oxide | 2 parts |

Then the reaction was further continued for 5 hours under a reduced pressure of from 10 to 15 mmHg (1332 to 1998 Pa).

Further, 44 parts of trimellitic anhydride was added to the vessel to be reacted with the reaction product for 2 hours at 180° C. under normal pressure. Thus, a low molecular weight polyester resin 1 was prepared. It was confirmed that the low molecular weight polyester resin 1 has a number average molecular weight of 2500, a weight average molecular weight of 6700, a glass transition temperature (Tg) of 43° C. and an acid value of 25 mgKOH/g.

Preparation Example 4

(Synthesis of Crystalline Polyester)

The following components were contained in a 5-liter four-necked flask equipped with a nitrogen feed pipe, a dewatering conduit, a stirrer and a thermocouple and reacted for 5 hours at 160° C.

| | |
|---|---|
| 1,4-butanediol | 25 moles |
| Fumaric acid | 23.75 moles |
| Trimellitic anhydride | 1.65 moles |
| Hydroquinone | 5.3 g |

Then the reaction was further continued for 1 hour at 200° C. Further, the reaction was continued for 1 hour under a pressure of 8.3 KPa. Thus, a crystalline polyester resin 1 was prepared. It was confirmed that the crystalline polyester 1 has a melting point of 119° C., a number average molecular weight of 710, a weight average molecular weight of 2100, an acid value of 24 mgKOH/g and a hydroxyl value of 28 mgKOH/g.

Preparation Example 4-2

The procedure for preparation of the crystalline polyester resin 1 was repeated except that the following components were used.

| | |
|---|---|
| 1,4-butanediol | 25 moles |
| Fumaric acid | 21.25 moles |
| Trimellitic anhydride | 5 moles |
| Hydroquinone | 5.7 g |

Thus, a crystalline polyester resin 2 was prepared. It was confirmed that the crystalline polyester 2 has a melting point of 96° C., a number average molecular weight of 620, a weight average molecular weight of 1750, an acid value of 37 mgKOH/g and a hydroxyl value of 8 mgKOH/g.

Preparation Example 4-3

The procedure for preparation of the crystalline polyester resin 1 was repeated except that the following components were used.

| | |
|---|---|
| 1,4-butanediol | 23.75 moles |
| Ethylene glycol | 1.25 moles |
| Fumaric acid | 22.75 moles |
| Trimellitic anhydride | 1.65 moles |
| Hydroquinone | 4.8 g |

Thus, a crystalline polyester resin 3 was prepared. It was confirmed that the crystalline polyester 3 has a melting point of 128° C., a number average molecular weight of 1650, a weight average molecular weight of 6400, an acid value of 24 mgKOH/g and a hydroxyl value of 44 mgKOH/g.

Preparation Example 4-4

The procedure for preparation of the crystalline polyester resin 1 was repeated except that the following components were used.

| | |
|---|---|
| 1,4-butanediol | 22.5 moles |
| Ethylene glycol | 5 moles |
| Fumaric acid | 23.75 moles |
| Trimellitic anhydride | 5 moles |
| Hydroquinone | 5.8 g |

Thus, a crystalline polyester resin 4 was prepared. It was confirmed that the crystalline polyester 4 has a melting point of 82° C., a number average molecular weight of 1100, a weight average molecular weight of 4700, an acid value of 25 mgKOH/g and a hydroxyl value of 33 mgKOH/g.

Preparation Example 4-5

The procedure for preparation of the crystalline polyester resin 1 was repeated except that the following components were used.

| | |
|---|---|
| 1,4-butanediol | 25 moles |
| Fumaric acid | 22.5 moles |
| Succinic acid | 1.25 moles |
| Trimellitic anhydride | 1.65 moles |
| Hydroquinone | 5.3 g |

Thus, a crystalline polyester resin 5 was prepared. It was confirmed that the crystalline polyester 5 has a melting point of 113° C., a number average molecular weight of 780, a weight average molecular weight of 2400, an acid value of 22 mgKOH/g and a hydroxyl value of 28 mgKOH/g.

Preparation Example 4-6

The procedure for preparation of the crystalline polyester resin 1 was repeated except that the following components were used.

| | |
|---|---|
| 1,4-butanediol | 23.75 moles |
| 1,6-hexanediol | 1.25 moles |
| Fumaric acid | 23 moles |
| Maleic acid | 0.75 moles |
| Trimellitic anhydride | 1.65 moles |
| Hydroquinone | 5.2 g |

Thus, a crystalline polyester resin 6 was prepared. It was confirmed that the crystalline polyester 6 has a melting point of 128° C., a number average molecular weight of 850, a weight average molecular weight of 3450, an acid value of 28 mgKOH/g and a hydroxyl value of 22 mgKOH/g.

Preparation Example 4-7

The procedure for preparation of the crystalline polyester resin 1 was repeated except that the following components were used.

| | |
|---|---|
| 1,4-butanediol | 22.5 moles |
| Ethylene glycol | 5 moles |
| Fumaric acid | 23.75 moles |
| Trimellitic anhydride | 2.5 moles |
| Hydroquinone | 5.5 g |

Thus, a crystalline polyester resin 7 was prepared. It was confirmed that the crystalline polyester 7 has a melting point of 75° C., a number average molecular weight of 1000, a weight average molecular weight of 4500, an acid value of 27 mgKOH/g and a hydroxyl value of 30 mgKOH/g.

Preparation Example 4-8

The procedure for preparation of the crystalline polyester resin 1 was repeated except that the following components were used.

| | |
|---|---|
| 1,4-butanediol | 25.5 moles |
| Ethylene glycol | 1.25 moles |
| Fumaric acid | 22.75 moles |
| Trimellitic anhydride | 2.6 moles |
| Hydroquinone | 4.8 g |

Thus, a crystalline polyester resin 8 was prepared. It was confirmed that the crystalline polyester 8 has a melting point of 134° C., a number average molecular weight of 1800, a weight average molecular weight of 8400, an acid value of 22 mgKOH/g and a hydroxyl value of 40 mgKOH/g.

Preparation Example 5

(Synthesis of Prepolymer)

The following components were contained in a reaction vessel equipped with a condenser, a stirrer, and a nitrogen feed pipe, and reacted for 8 hours at 230° C. under normal pressure.

| | |
|---|---|
| Propylene glycol | 463 parts |
| Terephthalic acid | 657 parts |
| Trimellitic anhydride | 96 parts |
| Titanium tetrabutoxide | 2 parts |

Then the reaction was further continued for 5 hours under a reduced pressure of 10 to 15 mmHg. Thus, an intermediate polyester 1 was prepared. It was confirmed that the intermediate polyester 1 has a weight average molecular weight of 28,000, a glass transition temperature of 36° C., an acid value of 0.5 mgKOH/g and a hydroxyl value of 16.5 mgKOH/g.

Next, the following components were contained in a reaction vessel equipped with a condenser, a stirrer, and a nitrogen feed pipe, and reacted for 5 hours at 100° C.

| | |
|---|---|
| Intermediate polyester 1 | 250 parts |
| Isophorone diisocyanate | 18 parts |
| Ethyl acetate | 250 parts |

Thus, a prepolymer 1 was prepared. The prepolymer 1 included isocyanate groups in an amount of 0.61%.

Preparation Example 6

(Synthesis of Ketimine Compound)

In a reaction vessel equipped with a stirrer and a thermometer, 170 parts of isophorone diamine and 75 parts of methyl ethyl ketone were mixed and reacted for 5 hours at 50° C. to prepare a ketimine compound. The ketimine compound has an amine value of 418 mgKOH/g.

Preparation Example 7

(Preparation of Master Batch)

The following components were mixed using a HENSCHEL MIXER mixer from Mitsui Mining Co., Ltd.

| | |
|---|---|
| Water | 1200 parts |
| Carbon black (PRINTEX 35 from Degussa A.G. having DBP oil absorption of 42 ml/100 g and pH of 9.5) | 540 parts |
| Low molecular weight polyester resin 1 | 1200 parts |

The mixture was kneaded for 30 minutes at 150° C. using a two roll mill. Then the kneaded mixture was cooled by rolling, followed by pulverization using a pulverizer. Thus, a master batch 1 was prepared.

The procedure for preparation of the master batch 1 was repeated except that the carbon black was replaced with a yellow pigment, Pigment Yellow 180 (NOVOPERM YELLOW P-HG from Clariant Corp.) which is a benzimidazolone-based pigment, to prepare a master batch 2.

The procedure for preparation of the master batch 1 was repeated except that the carbon black was replaced with a magenta pigment, Pigment Red 146 (PERMANENT RUBIN F-6B from Clariant Corp.) which is a naphthol-based pigment, to prepare a master batch 3.

The procedure for preparation of the master batch 1 was repeated except that the carbon black was replaced with a cyan pigment, Pigment Blue 15:3 (LIONOL BLUE FG7351 from Toyo Ink Manufacturing Co., Ltd.) which is a copper phthalocyanine-based pigment, to prepare a master batch 4.

Preparation Example 8

Preparation of Oil Phase Liquid

In a reaction vessel equipped with a stirrer and a thermometer, 378 parts of the low molecular weight polyester resin 1, 110 parts of a carnauba wax (WA-03 from Cerarica Noda Co., Ltd.), 22 parts of a charge controlling agent (E-84, a metal complex of salicylic acid, from Orient Chemical Industries Co., Ltd.), and 947 parts of ethyl acetate were mixed and the mixture was heated to 80° C. while agitated. After the mixture was heated at 80° C. for 5 hours, the mixture was cooled to 30° C. over 1 hour. Then 500 parts of the master batch 1 and 500 parts of ethyl acetate were added to the vessel, and the mixture was agitated for 1 hour to prepare a raw material dispersion 1.

Then 1324 parts of the raw material dispersion 1 was subjected to a dispersing treatment using a bead mill (ULTRAVISCOMILL from Aimex Co., Ltd.). The dispersing conditions were as follows.

Liquid feeding speed: 1 kg/hour

Peripheral speed of disc: 6 m/sec

Dispersion media: zirconia beads with a diameter of 0.5 mm

Filling factor of beads: 80% by volume

Repeat number of dispersing operation: 3 times (3 passes)

Then 1042.3 parts of a 65% ethyl acetate solution of the low molecular weight polyester resin 1 prepared above was added thereto. The mixture was subjected to the dispersion treatment using the bead mill. The dispersion conditions are the same as those mentioned above except that the dispersion operation was performed once (i.e., one pass).

The thus prepared colorant/wax dispersion 1 had a solid content of 50% when it was determined by heating the liquid at 130° C. for 30 minutes.

Preparation Example 9

Preparation of Dispersion of Crystalline Polyester

In a 2-liter metal container, 100 g of the crystalline polyester resin 1 was dissolved or dispersed in 400 g of ethyl acetate at 79° C. Then the solution or dispersion was rapidly cooled in an ice water bath. Five hundred (500) milliliters of glass beads having a diameter of 3 mm were added to the container, and the mixture was subjected to a dispersion treatment for 10 hours using a batch sandmill (from Kanpe Hapio Co., Ltd.). Thus, a crystalline polyester dispersion 1 having a volume average particle diameter of 0.4 mm was prepared.

Preparation Examples 10 to 16

The procedure for preparation of the crystalline polyester dispersion 1 was repeated except that the crystalline polyester resin was replaced with each of the crystalline polyesters 2-8.

Toner Preparation Example 1

(Emulsification and Solvent Removal)

Then the following components were mixed in a vessel.

| | |
|---|---|
| Colorant/wax dispersion (1) prepared above | 664 parts |
| Prepolymer (1) prepared above | 109.4 parts |
| Crystalline polyester dispersion 1 | 73.9 parts |
| Ketimine compound (1) prepared above | 4.6 parts |

The components were agitated for 1 minute with a TK HOMOMIXER from Tokushu Kika Kogyo K.K. at a revolution of 5,000 rpm. Thus, a toner composition liquid was prepared.

Next, 1,200 parts of the above-prepared aqueous phase liquid 1 was added to the above-prepared toner composition liquid and the mixture was mixed for 20 minutes using TK HOMOMIXER at a revolution of 13,000 rpm. Thus, an emulsion 1 was prepared.

The emulsion 1 was fed into a container equipped with a stirrer and a thermometer, and the emulsion was heated for 8 hours at 30° C. while agitated to remove the solvent from the emulsion. Then the emulsion was aged for 4 hours at 45° C. Thus, a dispersion 1 was prepared.

(Washing and Drying)

One hundred (100) parts of the dispersion 1 was filtered under a reduced pressure.

Then the wet cake was mixed with 100 parts of ion-exchange water and the mixture was agitated for 10 minutes with a TK HOMOMIXER at a revolution of 12,000 rpm, followed by filtering. Thus, a wet cake (a) was prepared.

The thus prepared wet cake (a) was mixed with 100 parts of a 10% sodium hydroxide and the mixture was agitated for 30 minutes with TK HOMOMIXER at a revolution of 12,000 rpm, followed by filtering under a reduced pressure. Thus, a wet cake (b) was prepared.

The thus prepared wet cake (b) was mixed with 100 parts of a 10% hydrochloric acid and the mixture was agitated for 10 minutes with TK HOMOMIXER at a revolution of 12,000 rpm, followed by filtering. Thus, a wet cake (c) was prepared.

Then the wet cake (c) was mixed with 300 parts of ion-exchange water and the mixture was agitated for 10 minutes with TK HOMOMIXER at a revolution of 12,000 rpm, followed by filtering. This operation was repeated twice. Thus, a wet cake (1) was prepared.

The wet cake (1) was dried for 48 hours at 45° C. using a circulating air drier, followed by sieving with a screen having openings of 75 μm.

Thus, black toner particles 1B were prepared.

The procedure for preparation of the black toner particles 1 was repeated except that the master batch was replaced with each of the master batches 2, 3 and 4, to prepare yellow toner particles 1Y, magenta toner particles 1M and cyan toner particles 1C. In this regard, the added amounts of the master batches 2, 3 and 4 were 500, 500 and 250 parts by weight, respectively.

Toner Preparation Example 2

The procedures for preparation of the toner particles 1B, 1Y, 1M and 1C were repeated except that the carnauba wax was replaced with 110 parts of a paraffin wax (150 from Nippon Seiro Co., Ltd.), and the crystalline polyester dispersion 1 was replaced with the crystalline polyester dispersion 2. Thus, black toner particles 2B, yellow toner particles 2Y, magenta toner particles 2M and cyan toner particles 2C were prepared.

Toner Preparation Example 3

The procedures for preparation of the toner particles 1B, 1Y, 1M and 1C were repeated except that the carnauba wax was replaced with 193 parts of a paraffin wax (155 from Nippon Seiro Co., Ltd.), and the crystalline polyester dispersion 1 was replaced with the crystalline polyester dispersion 3. Thus, black toner particles 3B, yellow toner particles 3Y, magenta toner particles 3M and cyan toner particles 3C were prepared.

Toner Preparation Example 4

The procedures for preparation of the toner particles 1B, 1Y, 1M and 1C were repeated except that the carnauba wax was replaced with 66 parts of a paraffin wax (140 from Nippon Seiro Co., Ltd.), and the crystalline polyester dispersion 1 was replaced with the crystalline polyester dispersion 4. Thus, black toner particles 4B, yellow toner particles 4Y, magenta toner particles 4M and cyan toner particles 4C were prepared.

Toner Preparation Example 5

The procedures for preparation of the toner particles 1B, 1Y, 1M and 1C were repeated except that the carnauba wax was replaced with 110 parts of a microcrystalline wax (HIMIC 2065 from Nippon Seiro Co., Ltd.), and the crystalline polyester dispersion 1 was replaced with the crystalline polyester dispersion 5. Thus, black toner particles 5B, yellow toner particles 5Y, magenta toner particles 5M and cyan toner particles 5C were prepared.

Toner Preparation Example 6

The procedures for preparation of the toner particles 1B, 1Y, 1M and 1C were repeated except that the carnauba wax was replaced with 110 parts of a Fischer-Tropsch wax (FT-0070 from Nippon Seiro Co., Ltd.), and the crystalline polyester dispersion 1 was replaced with the crystalline polyester dispersion 6. Thus, black toner particles 6B, yellow toner particles 6Y, magenta toner particles 6M and cyan toner particles 6C were prepared.

Toner Preparation Example 7

The procedures for preparation of the toner particles 1B, 1Y, 1M and 1C were repeated except that the added amount of the particulate material dispersion 1 used for the aqueous phase liquid was changed from 125 parts to 60 parts. Thus, black toner particles 7B, yellow toner particles 7Y, magenta toner particles 7M and cyan toner particles 7C were prepared.

Toner Preparation Example 8

The procedures for preparation of the toner particles 1B, 1Y, 1M and 1C were repeated except that the added amount of the particulate material dispersion 1 used for the aqueous phase liquid was changed from 125 parts to 185 parts. Thus, black toner particles 8B, yellow toner particles 8Y, magenta toner particles 8M and cyan toner particles 8C were prepared.

Toner Preparation Example 9

The procedures for preparation of the toner particles 1B, 1Y, 1M and 1C were repeated except that the condition (4 hours at 45° C.) of the aging was changed to a condition of 6 hours and 50° C. Thus, black toner particles 9B, yellow toner particles 9Y, magenta toner particles 9M and cyan toner particles 9C were prepared.

Toner Preparation Example 10

The procedures for preparation of the toner particles 1B, 1Y, 1M and 1C were repeated except that the condition (4 hours at 45° C.) of the aging was changed to a condition of 6 hours and 35° C. Thus, black toner particles 10B, yellow toner particles 10Y, magenta toner particles 10M and cyan toner particles 10C were prepared.

Toner Preparation Example 11

The procedures for preparation of the toner particles 1B, 1Y, 1M and 1C were repeated except that trimellitic anhydride was not used for preparing the low molecular weight polyester resin 1 in Preparation Example 3. Thus, black toner particles 11B, yellow toner particles 11Y, magenta toner particles 11M and cyan toner particles 11C were prepared.

Toner Preparation Example 12

The procedures for preparation of the toner particles 1B, 1Y, 1M and 1C were repeated except that the crystalline polyester dispersion was not used. Thus, black toner particles 12B, yellow toner particles 12Y, magenta toner particles 12M and cyan toner particles 12C were prepared.

Toner Preparation Example 13

The procedures for preparation of the toner particles 1B, 1Y, 1M and 1C were repeated except that the crystalline polyester dispersion 1 was replaced with the crystalline polyester dispersion 7. Thus, black toner particles 13B, yellow toner particles 13Y, magenta toner particles 13M and cyan toner particles 13C were prepared.

Toner Preparation Example 14

The procedures for preparation of the toner particles 1B, 1Y, 1M and 1C were repeated except that the crystalline polyester dispersion 1 was replaced with the crystalline polyester dispersion 8. Thus, black toner particles 14B, yellow toner particles 14Y, magenta toner particles 14M and cyan toner particles 14C were prepared.

One hundred (100) parts of each of the thus prepared toner particles 1-14 was mixed with 0.7 parts of a hydrophobized silica and 0.3 parts of a hydrophobized titanium oxide for 5 minutes using a HENSCHEL MIXER mixer (HENSCHEL 20B). Thus, 14 color toner sets were prepared.

Next, 7 parts of each of the toners was mixed with 93 parts by weight of a copper-zinc ferrite carrier having an average particle diameter of 35 μm to prepare color developer sets 1-14.

Example 1

The color developer set 1 was set in a color image forming apparatus having the configuration illustrated in FIG. 3 and including the first fixing device illustrated in FIG. 4A, and color images were produced to be evaluated. In this regard, the pressure at the fixing nip was 9.5 N/cm$^2$.

Example 2

The procedure for evaluation of the developer in Example 1 was repeated except that the color developer set 1 was replaced with the color developer set 2, and the pressure at the fixing nip was changed to 11.5 N/cm$^2$.

Example 3

The procedure for evaluation of the developer in Example 1 was repeated except that the color developer set 1 was replaced with the color developer set 3, and the fixing device was replaced with the second fixing device illustrated in FIG. 4B, wherein the pressure at the fixing nip was changed to 13.5 N/cm$^2$.

Example 4

The procedure for evaluation of the developer in Example 1 was repeated except that the color developer set 1 was replaced with the color developer set 4, and the fixing device was replaced with the third fixing device illustrated in FIG. 5A, wherein the pressure at the fixing nip was changed to 7.5 N/cm$^2$.

Example 5

The procedure for evaluation of the developer in Example 3 was repeated except that the color developer set 3 was replaced with the color developer set 4.

Example 6

The procedure for evaluation of the developer in Example 3 was repeated except that the color developer set 3 was replaced with the color developer set 5, and the pressure at the fixing nip was changed to 12.0 N/cm$^2$.

Example 7

The procedure for evaluation of the developer in Example 1 was repeated except that the color developer set 1 was replaced with the color developer set 6, and the fixing device was replaced with the fourth fixing device illustrated in FIG. 5B, wherein the pressure at the fixing nip was changed to 9.0 N/cm$^2$.

Comparative Example 1

The procedure for evaluation of the developer in Example 1 was repeated except that the fixing device was replaced with the third fixing device illustrated in FIG. 5A, and the pressure at the fixing nip was changed to 7.0 N/cm$^2$.

Comparative Example 2

The procedure for evaluation of the developer in Example 1 was repeated except that the color developer set 1 was replaced with the color developer set 7, and the pressure at the fixing nip was changed to 10.0 N/cm$^2$.

Comparative Example 3

The procedure for evaluation of the developer in Example 5 was repeated except that the color developer set 4 was replaced with the color developer set 8.

Comparative Example 4

The procedure for evaluation of the developer in Comparative Example 3 was repeated except that the color developer set 8 was replaced with the color developer set 1, and the pressure at the fixing nip was changed to 16.5 N/cm$^2$.

Comparative Example 5

The procedure for evaluation of the developer in Example 1 was repeated except that the color developer set 1 was replaced with the color developer set 9, and the pressure at the fixing nip was changed to 11.5 N/cm$^2$.

Comparative Example 6

The procedure for evaluation of the developer in Comparative Example 5 was repeated except that the color developer set 9 was replaced with the color developer set 10.

Comparative Example 7

The procedure for evaluation of the developer in Comparative Example 5 was repeated except that the color developer set 9 was replaced with the color developer set 11.

Comparative Example 8

The procedure for evaluation of the developer in Comparative Example 5 was repeated except that the color developer set 9 was replaced with the color developer set 12.

Comparative Example 9

The procedure for evaluation of the developer in Comparative Example 5 was repeated except that the color developer set 9 was replaced with the color developer set 13.

Comparative Example 10

The procedure for evaluation of the developer in Comparative Example 5 was repeated except that the color developer set 9 was replaced with the color developer set 14.

Example 8

(Preparation of Colorant Dispersion)

At first, the following components were mixed using a mixer having a stirring blade to prepare a primary dispersion of carbon black.

| | |
|---|---|
| Carbon black (REGAL 400 from Cabot Corp.) | 15 parts |
| Dispersant (AJISPER PB821 from Ajinomoto-Fine-Techno Co., Inc.) | 3 parts |
| Ethyl acetate | 82 parts |

The thus prepared primary dispersion was then further dispersed using a DYNO MILL to disperse the carbon black to an extent such that the dispersion does not include aggregated colorant particles. Thus, a secondary dispersion of carbon black was prepared. Further, the secondary dispersion was passed through a filter, which is made of polytetrafluoroethylene and has openings with a diameter of 0.45 μm, to prepare a dispersion in which the carbon black is dispersed so as to have an average particle diameter on the order of submicrons.

(Preparation of Toner Composition Liquid)

The following components were mixed for 10 minutes using a mixer having a stirring blade.

| | |
|---|---|
| Low molecular weight polyester resin 1 | 60 parts |
| Crystalline polyester resin 4 | 40 parts |
| Carbon black dispersion prepared above | 30 parts |
| Carnauba wax | 5 parts |
| Ethyl acetate | 26000 parts |

In this case, occurrence of a problem in that the carbon dispersion is coagulated when mixed with another material such as solvents could be prevented. Further, the dispersion was passed through a filter, which is made of polytetrafluoroethylene and has openings with a diameter of 0.45 μm, to prepare a dispersion (i.e., a toner composition liquid). There was no problem in that the filter is clogged with aggregated particles.

(Preparation of Toner)

Toner particles were prepared using the thus prepared dispersion (toner composition liquid) and the toner preparation apparatus illustrated in FIGS. 6 and 7.

The preparation conditions are as follows.

Nozzle: Nickel plate having circular openings with a diameter of 10 μm which are prepared by a femtosecond laser.

Specific gravity of dispersion: $\rho=1.1888$

Flow rate of dried air: 2.0 l/min (for orifice sheath)

3.0 l/min (for inside of apparatus)

Temperature of dried air: 80 to 82° C.

Temperature of inside of apparatus: 27 to 28° C.

Dew point: −20° C.

Voltage applied to electrode: 2.5 KV

Frequency of vibration of nozzle: 220 kHz

The dried toner particles were collected by suction using a filter having openings with a diameter of 1 μm. The thus collected toner particles have a weight average particle diameter of 3.2 μm and a number average particle diameter of 3.0 μm. Namely, small toner particles having a sharp particle diameter distribution could be prepared.

The procedure for preparation of the toner in Example 1 was repeated except that the toner particles were replaced with the above-prepared toner particles.

Thus, a black toner 15B was prepared. Similarly, color toner particles 15Y, 15M and 15C were prepared.

The evaluation methods are as follows.

1. Fixing Properties (1) Minimum Fixable Temperature and Maximum Fixable Temperature A color solid image having a weight of 0.60±0.05 mg/cm$^2$ was repeatedly formed on a sheet of a receiving paper (TYPE 6200 from Ricoh Co., Ltd.) while changing the temperature of the surface of the fixing member (film) to determine the lowest fixable temperature of the toner. The minimum fixable temperature is defined as the minimum temperature of the fixing member above which the ratio (IDa/IDb) of the image density (IDa) of the fixed solid image rubbed with a pad to the original image density of the fixed solid image (which is not rubbed with the pad) is not less than 0.70. The maximum fixable temperature is defined as the maximum temperature of the fixing member below which the fixed image has no hot offset phenomenon in that a part of the toner image is adhered to the fixing member, resulting in formation of an image having omissions.

(2) Fixable Temperature Range

The fixable temperature range is defined as the difference between the maximum fixable temperature and the minimum fixable temperature.

(3) Average Glossiness

The glossiness of randomly selected five portions of a solid color image fixed at a fixing temperature of 170° C. was measured at an angle of 60° C. with a digital gloss meter (VSG-1D from Nippon Denshoku Industries Co., Ltd.) to obtain the average glossiness.

(4) Condition of Fixing Member after 100,000 copies

A running test in which 100,000 copies of an original image having an image area proportion of 5% are continuously produced was performed. The fixing member was visually observed before and after the running test to determine whether the fixing member changes (e.g., whether the surface of the fixing member is scratched).

2. Image Qualities

1) Granularity

Seventeen-step half tone image patches (15 mm square), which are selected from the whole 256-step half tone image patches, were printed on a sheet of the receiving paper (TYPE 6200). The granularity means the degree of microscopic unevenness in image density of a solid image, which should be microscopically uniform in image density. The granularity (RMS granularity) of an image is represented by the following equation, which is defined in ANSI PH-2, 40-1985.

$$RMS\ \text{granularity}\ (\sigma D)=[(1/N)\cdot\Sigma(Di-D)^2]^{1/2} \quad (3),$$

wherein Di represents the measured image densities and D represents the average image density ($D=(1/N)\cdot\Sigma di$).

In addition, the GS granularity, which is defined using a power spectrum of an image density distribution and which is proposed by Dooley and Shaw of Xerox in Electrophotography, J. Appl. Photogr. Eng., 5, 4 (1979) pp 190-196, is also used.

$$GS\ \text{granularity}=\exp(-1.8D)\int(WS(f))^{1/2}\cdot VTF(f)df \quad (4),$$

wherein D represents the average image density, f represents the spatial frequency, WS(f) represents Winer Spectrum, and VTF(f) represents the spatial frequency property of eyes.

In the present application, the granularity is represented by the following equation, which is obtained by further developing the GS granularity.

$$\text{Granularity}=\exp(aL+b)\int(WSL(f))^{1/2}\cdot VTF(f)df \quad (5),$$

wherein L represents the average brightness, f represents spatial frequency, WSL(f) represents the power spectrum of brightness distribution, VTF(f) represents the spatial frequency property of eyes, and each of a and b is a coefficient (i.e., a=0.1044 and b=0.8944).

This equation uses brightness L* instead of image density D. This granularity has an advantage such that the linearity in the color space is superior to that of the GS granularity and therefore the granularity can be preferably used for evaluating color images.

The granularity of an image represents the noise property of the image. By evaluating the granularity of an image using the above-mentioned equation, the noise property of the image can be numerically expressed. In this regard, the lower, the better with respect to the granularity. In other words, as the granularity of an image increases, the microscopic evenness in image density of the image deteriorates.

In the present application, the granularity of a toner (a developer) was determined by scanning the seventeen-step half tone images printed by the toner with a scanner (FT-S5000 from Dainippon Screen Mfg. Co., Ltd.), and then calculating the granularity of the toner using equation (5).

Figure 8:
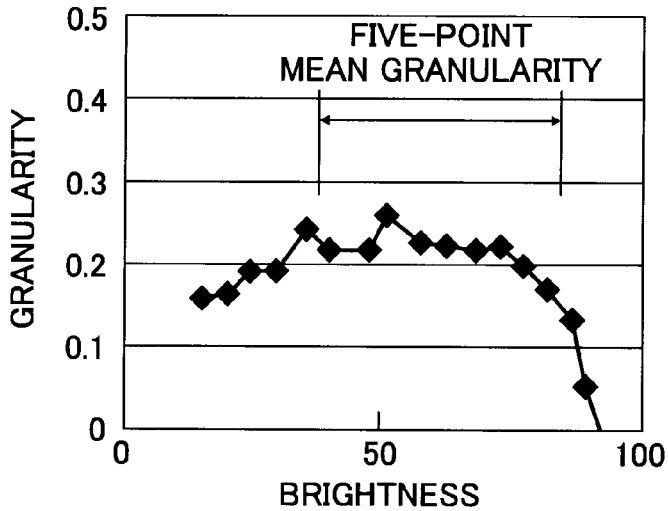
FIG. 8 is a graph for explaining how to determine the granularity of an image.

FIG. 8 is a graph illustrating the granularity of an image, wherein brightness is plotted on the horizontal axis and granularity is plotted on the vertical axis. In the graph, the granularity of each of 17-step half tone image patches having different brightness is plotted. Among these 17 image patches, 5 image patches having a brightness near 80, 70, 60, 50 and 40 are selected to average the granularity thereof. The granularity of the image is defined as the five-point mean granularity.

2) Cleaning Property

A running test in which one million copies of an original image are produced was performed. After every 100,000 copies, toner particles remaining on the image bearing member even after a cleaning operation were transferred to a piece of an adhesive tape (SCOTCH TAPE from Sumitomo 3M Ltd.). The piece of the adhesive tape and another piece of the adhesive tape (i.e., a reference), to which toner particles are not transferred, were attached to a white paper to measure the optical densities of the two pieces of the tape with a densitometer (RD-514 from Macbeth Co.). The cleaning property of the toner is defined as the difference between the optical densities.

The cleaning property is graded as follows.

Good: The optical density difference is not greater than 0.01.

Bad: The optical density difference is greater than 0.01.

3) Background Density

In the 1,000,000-copy running test mentioned above, a white solid image was produced after every 100,000 copies. Before the white solid image on the image bearing member was transferred to a receiving paper sheet, the image forming apparatus was switched off. Toner particles present on the image bearing member were transferred to a piece of an adhesive tape (SCOTCH TAPE from Sumitomo 3M Ltd.). The piece of the adhesive tape and another piece of the adhesive tape (i.e., a reference), to which toner particles are not transferred, were attached to a white paper to measure the optical densities of the two pieces of the tape using a spectrodensitometer (938 from X-Rite Inc.). The background density of the image is defined as the difference between the optical densities.

The background density is graded as follows.

Good: The optical density difference is not greater than 0.01.

Bad: The optical density difference is greater than 0.01.

The formulae of the toners 1-15 are shown in Table 1. The physical properties of the toners (cyan toners as a representative of the toners) are shown in Table 2. The image forming conditions are shown in Table 3. In addition, the fixing properties and the image qualities of the toners are shown in Tables 4-1 and 4-2.

TABLE 1

| | Release agent | | | Binder resin | | |
|---|---|---|---|---|---|---|
| Toner No. | Material | Melting Point (° C.) | Added amount (parts) | Pre-polymer | LMW PES* | CPES*2 (melting point (° C.)) |
| 1 | Carnauba Wax (WA-03) | 81 | 5 | Included | Included | 1 (119) |
| 2 | Paraffin Wax 150 | 66 | 5 | Included | Included | 2 (98) |
| 3 | Paraffin Wax 155 | 69 | 9 | Included | Included | 3 (128) |
| 4 | Paraffin Wax 140 | 61 | 3 | Included | Included | 4 (82) |
| 5 | Micro-Crystalline Wax HIMIC 2065 | 75 | 5 | Included | Included | 5 (113) |
| 6 | Fischer Tropsch Wax FT-0070 | 72 | 5 | Included | Included | 6 (128) |
| 7 | Paraffin Wax 150 | 66 | 5 | Included | Included | 2 (96) |
| 8 | Carnauba Wax (WA-03) | 81 | 5 | Included | Included | 1 (119) |
| 9 | Carnauba Wax (WA-03) | 81 | 5 | Included | Included | 1 (119) |
| 10 | Carnauba Wax (WA-03) | 81 | 5 | Included | Included | 1 (119) |
| 11 | Carnauba Wax (WA-03) | 81 | 5 | Included | Included (no trimellitic acid) | 1 (119) |
| 12 | Carnauba Wax (WA-03) | 81 | 5 | Included | Included | — |
| 13 | Carnauba Wax (WA-03) | 81 | 5 | Included | Included | 7 (75) |
| 14 | Carnauba Wax (WA-03) | 81 | 5 | Included | Included | 8 (134) |
| 15 | Carnauba Wax (WA-03) | 81 | 5 | Not included | Included | 1 (119) |

LMW PES*: Low molecular weight polyester
CPES*2: crystalline polyester

TABLE 2

| Toner No. | Particle diameter D4 (μm) | Dn (μm) | D4/Dn | Melt viscosity Gw110 | GW140 | GW110/GW140 | Tg (° C.) |
|---|---|---|---|---|---|---|---|
| 1 | 3.2 | 2.9 | 1.10 | 20500 | 600 | 34.2 | 50 |
| 2 | 2.7 | 2.4 | 1.13 | 3400 | 110 | 30.9 | 42 |
| 3 | 2.3 | 1.8 | 1.28 | 30000 | 550 | 54.5 | 46 |
| 4 | 4.2 | 3.6 | 1.17 | 38500 | 980 | 39.3 | 52 |
| 5 | 3.4 | 2.8 | 1.21 | 37000 | 150 | 246.7 | 48 |
| 6 | 3.4 | 3.0 | 1.13 | 36000 | 200 | 180.0 | 44 |
| 7 | 5.0 | 4.0 | 1.25 | 3400 | 110 | 30.9 | 42 |
| 8 | 1.8 | 1.5 | 1.20 | 20500 | 600 | 34.2 | 50 |
| 9 | 4.3 | 3.5 | 1.23 | 38500 | 1500 | 25.7 | 53 |
| 10 | 2.7 | 2.2 | 1.23 | 15000 | 900 | 16.7 | 50 |
| 11 | 3.3 | 2.6 | 1.27 | 2700 | 80 | 33.8 | 40 |
| 12 | 3.1 | 2.6 | 1.19 | 42000 | 1200 | 35.0 | 57 |
| 13 | 3.3 | 2.9 | 1.14 | 2800 | 70 | 40.0 | 39 |
| 14 | 3.6 | 3.0 | 1.20 | 42500 | 1500 | 28.3 | 59 |
| 15 | 3.2 | 3.0 | 1.07 | 4500 | 140 | 32.1 | 46 |

TABLE 3

| | No.of toner used | Fixing conditions: Fixing device | Pressure at nip (N/cm$^2$) | P × D4 |
|---|---|---|---|---|
| Example 1 | 1 | No. 1 (illustrated in FIG. 4A) | 9.5 | 30.4 |
| Example 2 | 2 | No. 1 | 11.5 | 31.1 |
| Example 3 | 3 | No. 2 (illustrated in FIG. 4B) | 13.5 | 31.1 |
| Example 4 | 4 | No. 3 (illustrated in FIG. 5A) | 7.5 | 31.5 |
| Example 5 | 4 | No. 2 | 13.5 | 56.7 |
| Example 6 | 5 | No. 2 | 12.0 | 40.8 |
| Example 7 | 6 | No. 4 (illustrated in FIG. 5B) | 9.0 | 30.6 |
| Example 8 | 15 | No. 1 | 11.5 | 36.8 |
| Comp. Ex. 1 | 1 | No. 3 | 7.0 | 22.4 |
| Comp. Ex. 2 | 7 | No. 1 | 10.0 | 50.0 |
| Comp. Ex. 3 | 8 | No. 2 | 13.5 | 24.3 |
| Comp. Ex. 4 | 1 | No. 2 | 16.5 | 52.8 |
| Comp. Ex. 5 | 9 | No. 1 | 11.5 | 49.5 |
| Comp. Ex. 6 | 10 | No. 1 | 11.5 | 31.1 |
| Comp. Ex. 7 | 11 | No. 1 | 11.5 | 38.0 |
| Comp. Ex. 8 | 12 | No. 1 | 11.5 | 35.7 |
| Comp. Ex. 9 | 13 | No. 1 | 11.5 | 38.0 |
| Comp. Ex. 10 | 14 | No. 1 | 11.5 | 41.4 |

TABLE 4-1

| | Fixing properties: Min. Fixable Temp. (° C.) | Max. Fixable Temp. (° C.) | Fixable range (degree) | Glossiness at 170° C. (%) | Condition of fixing member after running test |
|---|---|---|---|---|---|
| Example 1 | 135 | 220 | 85 | 21 | Good |
| Example 2 | 130 | 210 | 80 | 25 | Good |
| Example 3 | 135 | 220 | 85 | 23 | Good |
| Example 4 | 140 | 225 | 85 | 19 | Good |
| Example 5 | 135 | 200 | 65 | 21 | Good |
| Example 6 | 130 | 220 | 90 | 28 | Good |
| Example 7 | 140 | 220 | 80 | 18 | Good |
| Example 8 | 130 | 220 | 90 | 21 | Good |

TABLE 4-1-continued

| | Fixing properties: Min. Fixable Temp. (° C.) | Max. Fixable Temp. (° C.) | Fixable range (degree) | Glossiness at 170° C. (%) | Condition of fixing member after running test |
|---|---|---|---|---|---|
| Comp. Ex. 1 | 170 | 210 | 40 | 2 | Good |
| Comp. Ex. 2 | 130 | 190 | 60 | 24 | Good |
| Comp. Ex. 3 | 155 | 210 | 55 | 6 | Good |
| Comp. Ex. 4 | 130 | 220 | 90 | 27 | Surface of fixing member was scratched |
| Comp. Ex. 5 | 175 | 225 | 50 | — (not measured at 170° C.) | Good |
| Comp. Ex. 6 | 170 | 220 | 50 | 3 | Good |
| Comp. Ex. 7 | 130 | 160 | 30 | — (not measured at 170° C.) | Good |
| Comp. Ex. 8 | 180 | 225 | 45 | — (not measured at 170° C.) | Good |
| Comp. Ex. 9 | 130 | 160 | 30 | — (not measured at 170° C.) | Good |
| Comp. Ex. 10 | 180 | 225 | 45 | — (not measured at 170° C.) | Good |

TABLE 4-2

| | Image qualities: Granularity | Cleaning property | Background density | Overall evaluation |
|---|---|---|---|---|
| Example 1 | 0.21 | Good | Good | Good |
| Example 2 | 0.19 | Good | Good | Good |
| Example 3 | 0.23 | Good | Good | Good |
| Example 4 | 0.24 | Good | Good | Good |
| Example 5 | 0.25 | Good | Good | Good |
| Example 6 | 0.24 | Good | Good | Good |
| Example 7 | 0.20 | Good | Good | Good |
| Example 8 | 0.21 | Good | Good | Good |
| Comp. Ex. 1 | 0.22 | Good | Good | Bad |
| Comp. Ex. 2 | 0.42 | Good | Good | Bad |
| Comp. Ex. 3 | 0.18 | Bad | Bad | Bad |
| Comp. Ex. 4 | 0.21 | Good | Good | Bad |
| Comp. Ex. 5 | 0.25 | Good | Good | Bad |
| Comp. Ex. 6 | 0.21 | Good | Good | Bad |
| Comp. Ex. 7 | 0.23 | Good | Good | Bad |
| Comp. Ex. 8 | 0.21 | Good | Good | Bad |
| Comp. Ex. 9 | 0.22 | Good | Good | Bad |
| Comp. Ex. 10 | 0.24 | Good | Good | Bad |

Figure 9:
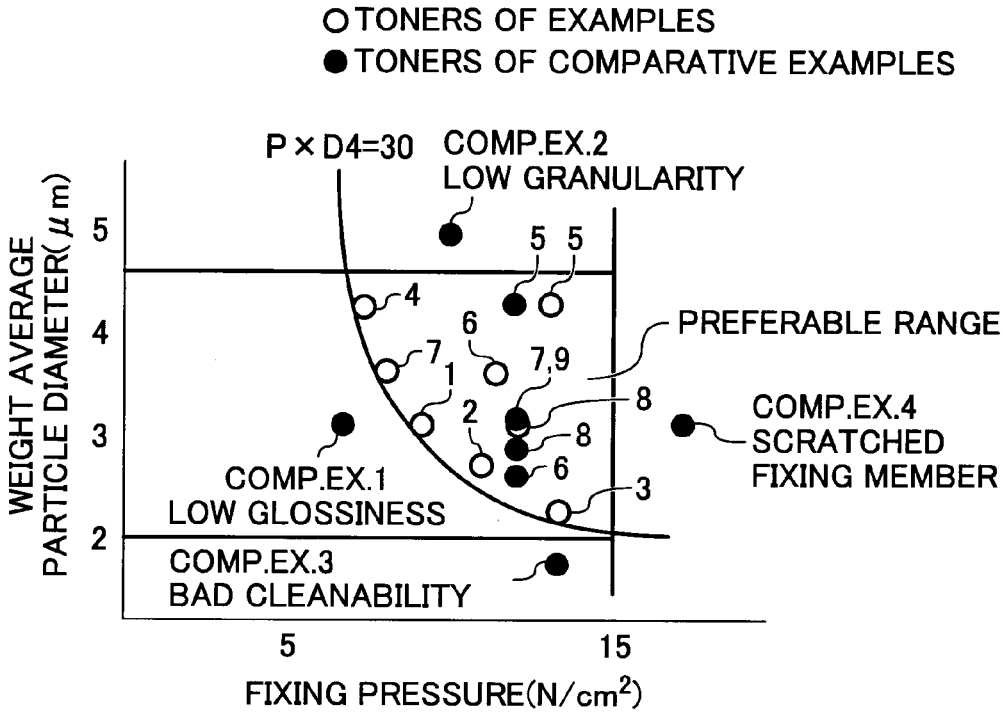
FIG. 9 is a graph illustrating the relationship among the fixing pressure, the weight average particle diameter of toners and the qualities of the toners.

As illustrated in FIG. 9, the toners of Comparative Examples 1, 2, 3, and 4, which are out of the preferable range, have drawbacks of having low glossiness, low granularity and bad cleanability, and scratching the fixing member, respectively. Although the toners of Comparative Examples 5-10 are within the preferable range, the toners are out of the preferable melt viscosity range mentioned below.

Figure 10A:
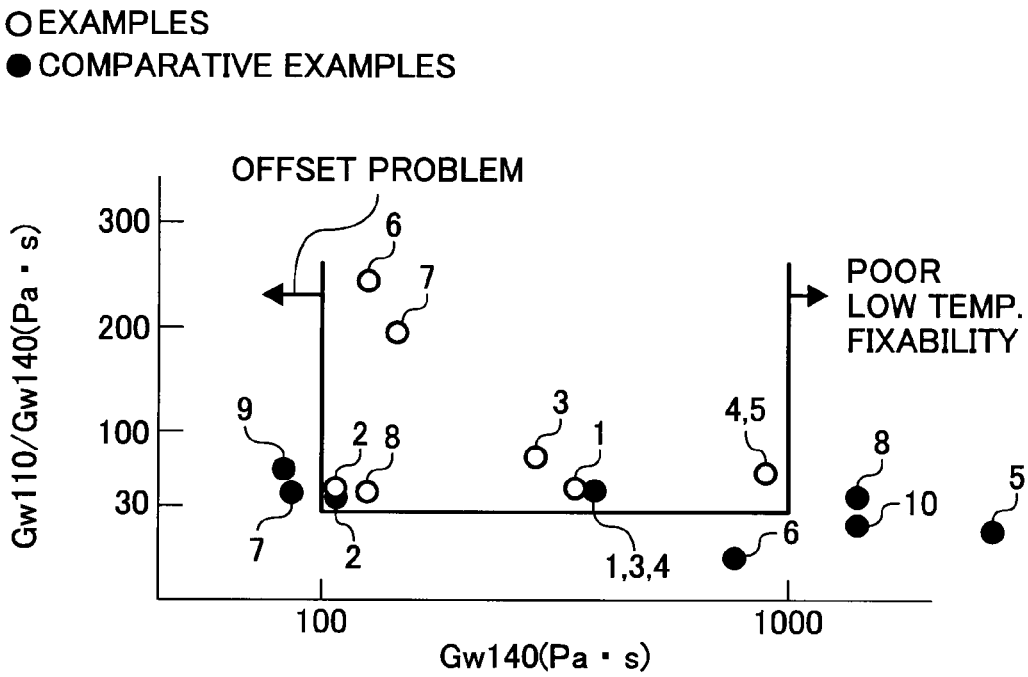
FIGS. 10A and 10B are graphs illustrating the relationships among melt viscosities (Gw110 and Gw140) of toners provided in Examples and Comparative Examples, the ratio of Gw110/Gw140) of the toners and image and the qualities of the toners.
Figure 10B:
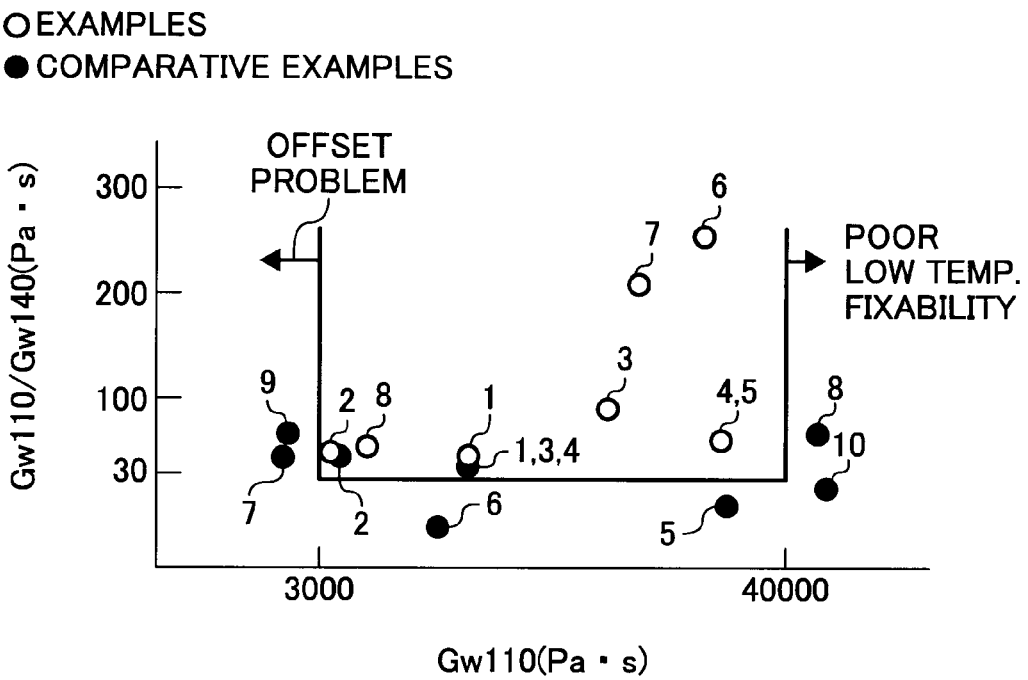

As illustrated in FIGS. 10A and 10B, the toners of Comparative Examples 7 and 9, which are out of the preferable melt viscosity range, have a drawback of causing the offset problem. The toners of Comparative Examples 5, 8 and 10, which are out of the preferable melt viscosity range, have a drawback of having poor low temperature fixability. Further, the toner of Comparative Example 6 has a drawback of having low glossiness. Although the toners of Comparative Examples 1, 2, 3, and 4 are within the preferable melt viscosity range, the toners are out of the preferable range in FIG. 9.

This document claims priority and contains subject matter related to Japanese Patent Application No. 2006-075659, filed on Mar. 17, 2006, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image forming method, comprising:

forming an image of a toner on a receiving material; and fixing the toner image on the receiving material upon application of heat and pressure thereto, wherein the following relationships (1) to (6) are satisfied:

$$2.0\ \mu m \leqq D4 \leqq 4.5\ \mu m \quad (1),$$

$$P \leqq 15\ N/cm^2 \quad (2),$$

$$P \times D4 \geqq 30\ N/cm^2 \cdot \mu m \quad (3),$$

$$3{,}000\ Pa \cdot s \leqq Gw110 \leqq 40{,}000\ Pa \cdot s \quad (4),$$

$$100\ Pa \cdot s \leqq Gw140 \leqq 1{,}000\ Pa \cdot s \quad (5), \text{ and}$$

$$Gw110/Gw140 \geqq 30 \quad (6),$$

wherein D4 represents a weight average particle diameter of the toner; Gw110 and Gw140 represent melt viscosities of the toner at 110 and 140° C., respectively; and P represents the pressure.

2. The image forming method according to claim 1, wherein the toner satisfies the following relationship:

$$D4/Dn \leqq 1.25,$$

wherein Dn represents a number average particle diameter of the toner.

3. The image forming method according to claim 1, wherein the toner has a glass transition temperature of from 40 to 55° C.

4. The image forming method according to claim 1, wherein the toner includes a binder resin including at least a crystalline polyester resin.

5. The image forming method according to claim 4, wherein the crystalline polyester resin has a melting point of from 80 to 130° C.

6. The image forming method according to claim 1, wherein the toner includes a release agent having a melting point of from 60 to 80° C.

7. The image forming method according to claim 1, wherein the toner includes a binder resin and a release agent, and wherein a weight ratio (R/B) of the release agent (R) and the binder resin (B) in the toner is from 0.03 to 0.10.

8. An image forming apparatus comprising:

an image bearing member configured to bear a toner image thereon;

a transfer device configured to transfer the toner image onto a receiving material; and a fixing device configured to fix the toner image on the receiving material upon application of heat and pressure thereto, wherein following relationships (1) to (6) are satisfied:

$$2.0\ \mu m \leqq D4 \leqq 4.5\ \mu m \quad (1),$$

$$P \leqq 15\ N/cm^2 \quad (2),$$

$$P \times D4 \geqq 30\ N/cm^2 \cdot \mu m \quad (3),$$

$$3{,}000\ Pa \cdot s \leqq Gw110 \leqq 40{,}000\ Pa \cdot s \quad (4),$$

$$100\ Pa \cdot s \leqq Gw140 \leqq 1{,}000\ Pa \cdot s \quad (5), \text{ and}$$

$$Gw110/Gw140 \geqq 30 \quad (6),$$

wherein D4 represents a weight average particle diameter of the toner; Gw110 and Gw140 represent melt viscosities of the toner at 110 and 140° C., respectively; and P represents the pressure.

* * * * *